US009224586B2

(12) United States Patent
Chen et al.

(10) Patent No.: US 9,224,586 B2
(45) **Date of Patent: *Dec. 29, 2015**

(54) APPARATUSES AND METHODS FOR PORTABLE MASS SPECTROMETRY

(75) Inventors: Chung-Hsuan Chen, Taipei (TW); Jung-Lee Lin, Banqiao (TW); Ming-Lee Chu, Xizhi (TW)

(73) Assignee: Academia Sinica, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/976,543

(22) Filed: Dec. 22, 2010

(65) Prior Publication Data

US 2011/0147581 A1 Jun. 23, 2011

Related U.S. Application Data

(60) Provisional application No. 61/289,531, filed on Dec. 23, 2009.

(51) Int. Cl.
*H01J 49/42* (2006.01)
*H01J 49/00* (2006.01)

(52) U.S. Cl.
CPC ..... *H01J 49/0022* (2013.01); *H01J 49/424* (2013.01); *H01J 49/429* (2013.01)

(58) Field of Classification Search
CPC ..... H01J 49/00
USPC ..... 250/281–300
See application file for complete search history.

(56) References Cited

U.S. PATENT DOCUMENTS 5,572,022 A 11/1996 Schwartz et al.
5,591,969 A 1/1997 Park et al.
6,262,638 B1 7/2001 Scherer
6,646,256 B2 11/2003 Gourley et al.
6,777,671 B2 * 8/2004 Doroshenko ..... 250/287
6,906,320 B2 6/2005 Sachs et al.
7,026,610 B2 * 4/2006 Kato ..... 250/285
7,084,396 B2 8/2006 Schneider (Continued)

FOREIGN PATENT DOCUMENTS

JP H09320516 A 12/1997
JP 2009277376 A 11/2009

(Continued)

OTHER PUBLICATIONS

NASA's Jet Propulsion Laboratory, "Induction Charge Detector With Multiple Sensing Stages" (Jan. 1, 2008).

(Continued)

*Primary Examiner* — Jack Berman
*Assistant Examiner* — Eliza Osenbaugh-Stewar
(74) *Attorney, Agent, or Firm* — Eckman Basu LLP

(57) ABSTRACT

Methods and apparatuses for portable mass spectrometry are disclosed. The apparatuses comprise at least one source of ionized analyte, at least one frequency scanning subsystem, at least one detector, and optionally at least one vacuum pump, and are portable. In some embodiments, the apparatuses comprise multiple sources of ionized analyte and/or are configured to obtain mass spectra of a large analyte, such as analyte with an m/z ratio of at least $10^5$, or analyte with a molecular weight of at least $10^5$ Da, as well as mass spectra of small molecule analyte. In some embodiments, the methods comprise obtaining mass spectra with a portable apparatus described above.

16 Claims, 21 Drawing Sheets

(56) References Cited

U.S. PATENT DOCUMENTS

| | | | | |
|---|---|---|---|---|
| 7,161,147 | B1 | 1/2007 | Chang et al. | |
| 7,329,866 | B2 * | 2/2008 | Wang | 250/290 |
| 7,928,361 | B1 * | 4/2011 | Whitehouse et al. | 250/281 |
| 8,507,846 | B2 * | 8/2013 | Chen et al. | 250/282 |
| 2003/0122070 | A1 | 7/2003 | Chang et al. | |
| 2004/0069943 | A1 | 4/2004 | Kato | |
| 2005/0153341 | A1 | 7/2005 | Alexander et al. | |
| 2006/0273251 | A1 * | 12/2006 | Verbeck et al. | 250/281 |
| 2006/0284074 | A1 | 12/2006 | Chang et al. | |
| 2007/0131871 | A1 | 6/2007 | Chang et al. | |
| 2007/0272852 | A1 | 11/2007 | Miller et al. | |
| 2008/0149821 | A1 | 6/2008 | Senko | |
| 2009/0072136 | A1 * | 3/2009 | Pringle et al. | 250/290 |
| 2009/0189069 | A1 | 7/2009 | Chen et al. | |
| 2010/0065740 | A1 | 3/2010 | Iwamoto | |
| 2010/0127167 | A1 * | 5/2010 | Schropp et al. | 250/288 |
| 2010/0276582 | A1 | 11/2010 | Chen et al. | |
| 2010/0301199 | A1 | 12/2010 | Chen et al. | |

FOREIGN PATENT DOCUMENTS

| | | | |
|---|---|---|---|
| WO | WO2008/042949 | A2 | 4/2008 |
| WO | 2008129850 | A | 10/2008 |
| WO | 2009105080 | A | 8/2009 |

OTHER PUBLICATIONS

A. Keil et al., "Ambient Mass Spectrometry with a Handheld Mass Spectrometer at High Pressure," Anal. Chem., 79:7734-7739 (2007).
B. Bothner et al., "Electrospray ionization of a whole virus: analyzing mass, structure, and viability," ChemBioChem 5:258-60 (2004).
D. L. Tabb et al., "DTASelect and Contrast: Tools for Assembling and Comparing Protein Identifications from Shotgun Proteomics," J. Proteome Res., 1:21-26 (2002).
E. de Hoffmann and V. Stroobant, Mass Spectrometry: Principles and Applications, Chapters 1-3, 3rd Ed., John Wiley & Sons Inc., 2007.
G. Siuzdak, The Expanding Role of Mass Spectrometry in Biotechnology, 2nd Ed. MCC Press, San Diego. Chapters 1-2 (2006).
J. C. Schultz et al., "Mass determination of megadalton-DNA electrospray ions using charge-detection mass spectrometry," J. Am. Soc. Mass Spectrom. 9:305-313 (1998).
J. L. Campbell et al., "Analysis of polyethylene by using cyclopentadienyl cobalt chemical ionization combined with laser-induced acoustic desorption/fourier transform ion cyclotron resonance mass spectrometry," Anal. Chem. 77:4020-6 (2005).
J. L. Jimenez et al., "Ambient aerosol sampling using the Aerodyne aerosol mass spectrometer," J. Geophys. Res. 108:8425-37 (2003).
J. Somuramasami et al., "Evaluation of a Novel Approach for Peptide Sequencing: Laser-Induced Acoustic Desorption Combined with $P(OCH_3)_2^+$ Chemical Ionization and Collision-activated Dissociation in a Fourier Transform Ion Cyclotron Resonance Mass Spectrometer," J Am Soc Mass Spectrom. 18:525-40. (Mar. 2007) (Epub Dec. 6, 2006).
J. M. Wells et al., "Chemical Mass Shifts in Ion Trap Mass Spectrometry: Experiments and Simulations," Anal. Chem.71:3405-3415 (1999).
J. Qin et al., "Matrix-Assisted Laser Desorption Ion Trap Mass Spectrometry: Efficient Isolation and Effective Fragmentation of Peptide Ions," Anal. Chem. 68:2108-2112 (1996).
K.-M. Lue et al., "Quadrupole mass spectrometer measurements of electrostatic sprays," Inst. Phys. Conf. Series 85: 337-342 (1987).
K. Tanaka et al., "Protein and polymer analyses up to m/z 100 000 by laser ionization time-of-flight mass spectrometry," Rapid Commun. Mass Spectrom. 2: 151-153 (1988).
L. Gao et al., "Design and Characterization of a Multisource Hand-Held Tandem Mass Spectrometer," Anal. Chem., 80:7198-7205 (2008).
L. Gao et al., "Characterization of a Discontinuous Atmospheric Pressure Interface. Multiple Ion Introduction Pulses for Improved Performance," International Journal of Mass Spectrometry, 283:30-34 (2009).
L. Salsac et al., "Glow Discharges: Glow Discharges in low-pressure gases," SARL Atout & Progrés, Paris, France (Parts first published Oct. 17, 2006, and Sep. 12, 2007).
M. A. Meetani et al., "Desorption electrospray ionization mass spectrometry of intact bacteria," Journal of Mass Spectrometry, 42:1186-1193 (2007).
M. A. Tito et al., "Electrospray time-of-flight mass spectrometry of the intact MS2 virus capsid," J. Am. Chem. Soc. 122: 3550-51 (2000).
M. Huang et al., "Sonic Spray Nebulizer for Inductively Coupled Plasma Atomic Emission Spectrometry," Anal. Sciences, 15:265-268 (1999).
M. Karas et al., "Laser desorption ionization of proteins with molecular masses exceeding 10 000 Daltons," Anal. Chem., 60:2299-301 (1988).
M. Karas et al., "Matrix-Assisted Ultraviolet Laser Desorption of Non-Volatile Compounds," Int. J. Mass Spectrom. Ion. Proc., 78:53-68 (1987).
M. Makowski et al., "Ab initio study of the energetic of protonation, deprotonation and homocomplexed cations and anions formulation in systems modeling side chains of biomolecules," J. Mol. Struct.: Theochem, 674:61-67 (2004).
M. T. Ngyuen et al., "Protonation and deprotonation energies of uracil Implications for the uracil-water complex," J. Chem. Soc. Faraday Trans., 94:1277-1280 (1998).
N. Jensen, "Vapor Pressure of Plastic Materials," Journal of Applied Physics, 27:1460-1462 (1956).
P. W. Geno et al., "Secondary electron emission induced by impact of low-velocity molecular ions on a microchannel plate," Int. J. Mass Spectrom. Ion Processes 92:195-210 (1989).
R. C. Shea et al., "Characterization of laser-induced acoustic desorption coupled with a fourier transform ion cyclotron resonance mass spectrometer," Anal. Chem. 78:6133-9 (2006).
R. Chen et al., "Trapping, detection, and mass determination of coliphage T4 DNA ions of $10^8$ Da by electrospray ionization fourier transform ion cyclotron resonance mass spectrometry", Anal. Chem. 67: 1159-1163 (1995).
R. G. Cooks et al., "Ambient Mass Spectrometry," Science 311:1566-1570 (2006).
R. Haddad et al., "Desorption sonic spray ionization for (high) voltage-free ambient mass spectrometry," Rapid Comm. Mass Spectrom., 20:2901-2905 (2006).
R. Redmer, "Physical properties of dense, low-temperature plasmas," Phys. Reports, 282:35-157 (1997).
S. Aderogba et al., "Nanoelectrospray ion generation for high-throughput mass spectrometry using a micromachined ultrasonic ejector array," Appl. Phys. Lett., 86:203110-1-203110-3 (2005).
S. Berkenkamp et al., "Infrared MALDI Mass Spectrometry of Large Nucleic Acids," Science, 281:260-262 (1998).
S. A. Ecelberger et al., "Suitcase TOF: A Man-Portable Time-of-Flight Mass Spectrometer," Johns Hopkins APL Technical Digest, 25:14-19 (2004).
S. D. Fuerstenau et al., "Mass Spectrometry of an intact virus," Angew Chem Int Ed Engl. 40: 542-544 (2001); Corrigendum: Angew. Chem. Int. Ed. 40: 982 (2001) (refers to pp. 541-544).
S. F. Wong et al., "Multiple charging in electrospray ionization of poly(ethylene glycols)," J. Phys. Chem. 92:546-50 (1988).
S.D. Fuerstenau et al., "Molecular weight determination of megadalton DNA electrospray ions using charge detection time-of-flight mass spectrometry," Rapid Comm. Mass Spectrom., 9:1528-1538 (1995).
S.D. Fuerstenau, "Whole Virus Mass Analysis by Electrospray Ionization," J. Mass. Spectrom. Soc. Japan., 51:50-53 (2003).
V.V. Golovlev et al., "Laser-induced acoustic desorption of electrons and ions", Appl. Phys. Lett. 71: 852-854 (1997).
V. V. Golovlev et al., "Laser-induced acoustic desorption," Int. J. Mass Spectrom. Ion Processes 169/170: 69-78 (1997).
V. V. Golovlev et al., "Nonresonant MALDI of Oligonucleotides: Mechanism of Ion Desorption," Anal. Chem., 73:809-812 (2001).
W. Aberth et al., "Secondary ion mass spectrometry with cesium ion primary beam and liquid target matrix for analysis of bioorganic compounds," Anal. Chem. 54:2029-2034 (1982).

(56) References Cited

OTHER PUBLICATIONS

W. J. Henzel et al.; "Identifying proteins from two-dimensional gels by molecular mass searching of peptide fragments in protein sequence databases," Proc. Natl. Acad. Sci. USA 90:5011-5015 (1993).
W.-P. Peng et al., "Charge Monitoring Cell Mass Spectrometry," Analytical Chemistry, 80(7): 2524-2530 (2008).
W.-P. Peng et al., "Charge-Monitoring Laser-Induced Acoustic Desorption Mass Spectrometry for Cell and Microparticle Mass Distribution Measurement," Angew. Chem. Int. Ed., 46:3865-3869 (2007).
W.-P. Peng et al., "Laser-Induced Acoustic Desorption Mass Spectrometry of Single Bioparticles," Angewandte Chemie Int. Ed., 45:1423-1426 (2006).
W.-P. Peng et al., "Molar mass and molar mass distribution of polystyrene particle size standards," Anal. Chem., 77: 7084-7089 (2005).
Y. Cai et al., "Ion trap mass spectrometry of fluorescently labeled nanoparticles," Anal. Chem. 75:1805-11 (2003).
Y. Hirabayashi and A. Hirabayashi, "Capillary Isoelectric Focusing Separation Combined with Mass Spectrometry Using Sonic Spray Ionization for Protein Analysis," J. Mass. Spectrom. Soc. Jpn., 50:21-23 (2002).
Z. Nie et al., "Microscopy-based mass measurement of a single whole virus in a cylindrical ion trap," Angew. Chem., 118:8311-8314 (2006).
Z. Ouyang et al., "Miniature Mass Spectrometers," Annu. Rev. Anal. Chem., 2:187-214 (2009).
Z. Takats et al., "Electrosonic Spray Ionization. A Gentle Technique for Generating Folded Proteins and Protein Complexes in the Gas Phase and for Studying Ion-Molecule Reactions at Atmospheric Pressure," Anal. Chem., 76:4050-4058 (2004).
Z. Takats et al., "Amino Acid Clusters Formed by Sonic Spray Ionization," Anal. Chem., 75:1514-1523 (2003).
International Search Report for PCT/US2010/061821 and Written Opinion, mailed Mar. 8, 2011.
Qin, Anal Chem 1996 vol. 68, pp. 2108-2112.

* cited by examiner

APPARATUSES AND METHODS FOR PORTABLE MASS SPECTROMETRY

This application claims benefit of priority under 35 U.S.C. §119 to U.S. provisional patent application No. 61/289,531, filed Dec. 23, 2009, the entire contents of which are incorporated herein by reference.

FIELD OF THE INVENTION

This invention relates to the field of mass spectrometry, in particular, mass spectrometry involving portable instruments, including mass spectrometry using samples comprising small molecule analyte or analyte with a high molecular weight or mass-to-charge (m/z) ratio.

BACKGROUND OF THE INVENTION

Spectrometry is the art of inferring information about an analyte based on its interaction with electromagnetic fields and radiation. Mass spectrometry (MS), as its name suggests, is concerned with measurements of mass. Mass spectrometers have been called the smallest scales in the world because some of them can 'weigh' a single atom. Over time, the use of mass spectrometry has been expanded to larger and larger molecules, including macromolecules. It has also become possible to construct lighter and more compact mass spectrometers, such that some of these instruments are portable, or can even be hand-carried, and can be used in the field; however, these instruments have serious limitations.

Mass spectrometers generally involve a source of ionized analyte, a mass analyzer, and a detector. The mass analyzer and detector operate under reduced pressure relative to the atmosphere, and said reduced pressure can be provided by a vacuum pump. In portable instruments, it can be important to optimize these components to result in a light weight and compact instrument than nonetheless maintains high performance. As mass spectrometry in general has become compatible with larger and larger analytes, MS has been applied frequently in laboratory settings to identify macromolecules or even larger analytes in biological and chemical samples. In the post-genomic era, there is more interest than ever in the characterization of increasingly massive macromolecular assemblies, and even larger bioparticles such as viruses and whole cells. Prior to this invention, the upper bound of the size of analytes suitable for MS with a portable instrument was limited, and the ability to analyze macromolecules without hard vacuum (e.g., $<10^{-5}$ Torr) was even more limited. Therefore, it was difficult or impossible to perform MS with large analytes outside of a laboratory setting—for example, in forensic, ecological, environmental, anthropological, and archaeological field work, in mobile medical settings such as a van-based clinical or screening enterprise or in developing nations, and in screening for pollutants or contaminants, e.g., for security, food safety, or environmental protection purposes. However, the rewards of such portable technology can include making its analytical power more accessible in a more rapid manner. The reduction in space and cost from a portable instrument can also be useful in laboratory applications, including biomedical research in fields such as proteomics, genomics, metabolomics, and biomarker discovery, and in structural studies and characterization of nanomaterials.

SUMMARY OF THE INVENTION

An embodiment of the invention is an apparatus for mass spectrometry comprising (a) at least one source of ionized analyte; (b) a mass analyzer comprising at least one ion trap; (c) at least one frequency scanning subsystem; (d) at least one detector; and (e) optionally at least one vacuum pump; wherein the apparatus is portable.

In some embodiments, the apparatus comprises at least one vacuum pump.

In some embodiments, the apparatus does not comprise a vacuum pump.

In some embodiments, the at least one source of ionized analyte comprises at least two mechanistically different sources of ionized analyte.

In some embodiments, the at least two mechanistically different sources of ionized analyte comprise: (a) a first source of ionized analyte chosen from a MALDI source and a LIAD source; and (b) at least one additional source of ionized analyte mechanistically different from the first source of ionized analyte.

In some embodiments, the apparatus is human-portable.

In some embodiments, the at least one ion trap is configured to operate via frequency scan.

In some embodiments, the at least one ion trap is configured to operate via frequency scan with a minimum frequency less than or equal to 100,000 Hz.

In some embodiments, the at least one ion trap is configured to operate via frequency scan with a minimum frequency less than or equal to 10,000 Hz.

In some embodiments, the at least one ion trap is configured to operate via frequency scan with a minimum frequency less than or equal to 1,000 Hz.

In some embodiments, the at least one ion trap is configured to operate via frequency scan with a minimum frequency less than or equal to 100 Hz.

In some embodiments, the at least one ion trap comprises an ion trap chosen from a quadrupole ion trap, a rectilinear ion trap, and a linear ion trap.

In some embodiments, the at least two different sources of ionized analyte are chosen from a LIAD source, a MALDI source, an ESI source, an EI source, a GDEI source, an APCI source, a DESI source, a DART source, an LTP source, a UI source, an EII source, and an EA source.

In some embodiments, the at least two mechanistically different sources of ionized analyte are structurally different.

In some embodiments, the at least two mechanistically different sources of ionized analyte are chosen from a LIAD source, a MALDI source, and an ESI source.

In some embodiments, the at least two mechanistically different sources of ionized analyte comprise a LIAD source and a MALDI source.

In some embodiments, the at least two mechanistically different sources of ionized analyte comprise a LIAD source and an ESI source.

In some embodiments, the at least two mechanistically different sources of ionized analyte comprise a MALDI source and an ESI source.

In some embodiments, the at least two mechanistically different sources of ionized analyte comprise a LIAD source, a MALDI source, and an ESI source.

In some embodiments, the apparatus is configured to obtain a mass spectrum of an analyte having an m/z ratio of 20 or greater.

In some embodiments, the apparatus is configured to obtain a mass spectrum of an analyte having an m/z ratio of greater than or equal to $10^5$ and of an analyte having an m/z ratio of less than or equal to 1,000.

In some embodiments, the apparatus is configured to obtain a mass spectrum of an analyte having an m/z ratio of greater than or equal to $10^5$ and of an analyte having an m/z ratio of less than or equal to 100.

In some embodiments, the apparatus is configured to obtain a mass spectrum of an analyte having an m/z ratio of greater than or equal to $10^6$ and of an analyte having an m/z ratio of less than or equal to 1,000.

In some embodiments, the apparatus is configured to obtain a mass spectrum of an analyte having an m/z ratio of greater than or equal to $10^9$ and of an analyte having an m/z ratio of less than or equal to 1,000.

In some embodiments, the apparatus is configured to obtain a mass spectrum of an analyte having an m/z ratio of greater than or equal to $10^{12}$ and of an analyte having an m/z ratio of less than or equal to 1,000.

In some embodiments, the apparatus is configured to obtain a mass spectrum of an analyte having a molecular weight of 20 Da or greater.

In some embodiments, the apparatus is configured to obtain a mass spectrum of an analyte having a molecular weight of at least $10^5$ Da and of an analyte having a molecular weight of less than or equal to 1,000 Da.

In some embodiments, the apparatus is configured to obtain a mass spectrum of an analyte having a molecular weight of at least $10^5$ Da and of an analyte having a molecular weight of less than or equal to 100 Da.

In some embodiments, the apparatus is configured to obtain a mass spectrum of an analyte having a molecular weight of at least $10^6$ Da and of an analyte having a molecular weight of less than or equal to 1,000 Da.

In some embodiments, the apparatus is configured to obtain a mass spectrum of an analyte having a molecular weight of at least $10^9$ Da and of an analyte having a molecular weight of less than or equal to 1,000 Da.

In some embodiments, the apparatus is configured to obtain a mass spectrum of an analyte having a molecular weight of at least $10^{12}$ Da and of an analyte having a molecular weight of less than or equal to 1,000 Da.

In some embodiments, the at least one detector comprises a detector chosen from a direct charge detector, a charge amplification detector, and a light scattering detector.

In some embodiments, the at least one detector comprises a detector chosen from a Faraday plate, a Faraday cup, an induction charge detector, a microchannel plate, a microsphere plate, a electromultiplier, a channeltron, and a CCD camera.

In some embodiments, the at least one detector comprises at least two mechanistically different detectors.

In some embodiments, the at least two mechanistically different detectors are structurally different.

In some embodiments, the apparatus is configured to measure analyte charge and analyte m/z ratio.

In some embodiments, the at least two different detectors comprise a direct charge detector and a charge amplification detector.

In some embodiments, the direct charge detector comprises a Faraday plate or cup and the charge amplification detector comprises a channeltron.

In some embodiments, the apparatus has a mass of less than 40 kg.

In some embodiments, the apparatus has a mass of less than 25 kg.

In some embodiments, the apparatus further comprises a chromatograph configured to provide analyte to the source of ionized analyte.

In some embodiments, the chromatograph configured to provide analyte to the source of ionized analyte is configured to perform high performance liquid chromatography.

In some embodiments, the frequency scanning subsystem of the apparatus comprises an arbitrary function generator.

In some embodiments, the frequency scanning subsystem of the apparatus comprises a sweeping sine wave synthesizer.

In some embodiments, the frequency scanning subsystem of the apparatus comprises a tunable element chosen from a tunable capacitor and a tunable inductor.

In some embodiments, the at least one source of ionized analyte comprises at least two of MALDI, LIAD, and ESI sources, the mass analyzer comprises an ion trap comprising a vacuum chamber composed of >50% plastic by weight and is configured to operate via frequency scan with a minimum frequency less than or equal to 100 Hz, the at least one detector comprises at least a direct charge detector and a charge amplification detector, the apparatus is configured to obtain a mass spectrum of an analyte having an m/z ratio greater than or equal to $10^{12}$ and of an analyte having an m/z ratio less than or equal to 1,000, and the apparatus has a mass of less than 25 kg.

Another embodiment of the invention is a method of obtaining a mass spectrum comprising (a) providing a sample comprising an analyte, and an apparatus of the invention; (b) using the at least one source of ionized analyte of the apparatus to ionize the analyte if it is neutral and introducing it into the mass analyzer of the apparatus; (c) sorting the analyte according to its m/z ratio; and (d) detecting analyte sorted according to its m/z ratio, thereby obtaining a mass spectrum.

In some embodiments, sorting the analyte according to its m/z ratio comprises performing a frequency scan.

In some embodiments, performing a frequency scan comprises scanning over a frequency range including 200 Hz.

In some embodiments, the frequency range extends from less than or equal to 100 Hz to greater than or equal to 10,000 Hz.

In some embodiments, performing a frequency scan comprises scanning over a frequency range including 1,000 Hz.

In some embodiments, performing a frequency scan comprises scanning over a frequency range including 10,000 Hz.

In some embodiments, performing a frequency scan comprises scanning over a frequency range including 100,000 Hz.

Another embodiment of the invention is a method of obtaining a mass spectrum comprising (a) providing a sample comprising an analyte, and an apparatus of the invention; (b) using the at least one source of ionized analyte of the apparatus to ionize the analyte if it is neutral and introducing it into the mass analyzer of the apparatus; (c) sorting the analyte according to its m/z ratio; (d) detecting analyte sorted according to its m/z ratio, thereby obtaining a first mass spectrum, and selecting a mass range or an m/z range within the first mass spectrum; and (e) repeating steps (b) through (d) to obtain a second mass spectrum, wherein the second mass spectrum covers said mass range or said m/z range at a resolution greater than that of the first mass spectrum. In some embodiments, the sorting the analyte according to its m/z ratio comprised by the repeating steps (b) through (d) comprises performing a voltage scan.

Another embodiment of the invention is a method of obtaining a mass spectrum comprising (a) providing a sample comprising an analyte, and an apparatus of the invention; (b) using the at least one source of ionized analyte of the apparatus to ionize the analyte if it is neutral and introducing it into the mass analyzer of the apparatus; (c) sorting the analyte according to its m/z ratio, wherein the sorting comprises performing a voltage scan; and (d) detecting analyte sorted according to its m/z ratio, thereby obtaining a mass spectrum.

In some embodiments, the sample comprises analyte with a molecular weight of less than or equal to $10^5$ Da or an m/z ratio of less than or equal to $10^5$, and the mass spectrum comprises a peak corresponding to a molecular weight of less than or equal to $10^5$ Da or an m/z ratio of less than or equal to $10^5$.

In some embodiments, the sample comprises analyte with a molecular weight of less than or equal to $10^3$ Da or an m/z ratio of less than or equal to $10^3$, and the mass spectrum comprises a peak corresponding to a molecular weight of less than or equal to $10^3$ Da or an m/z ratio of less than or equal to $10^3$.

In some embodiments, the sample comprises analyte with a molecular weight of greater than or equal to $10^5$ Da or an m/z ratio of greater than or equal to $10^5$, and the mass spectrum comprises a peak corresponding to a molecular weight of at least $10^5$ Da or an m/z ratio of at least $10^5$.

In some embodiments, the sample comprises analyte with a molecular weight of greater than or equal to $10^6$ Da or an m/z ratio of greater than or equal to $10^6$, and the mass spectrum comprises a peak corresponding to a molecular weight of at least $10^6$ Da or an m/z ratio of at least $10^6$.

Another embodiment of the invention is a method of obtaining a mass spectrum comprising (a) providing a sample comprising an analyte, and an apparatus of the invention; (b) using the at least one source of ionized analyte of the apparatus to ionize the analyte if it is neutral and introducing it into the mass analyzer of the apparatus; (c) sorting the analyte according to its m/z ratio; and (d) detecting analyte sorted according to its m/z ratio, thereby obtaining a mass spectrum; wherein the ion trap has an internal gas pressure of ambient atmospheric pressure during steps (c) and (d). In some embodiments, the ion trap has an internal gas pressure ranging from 0.01 mTorr to 760 Torr during steps (c) and (d). In some embodiments, the internal gas pressure ranges from 0.1 mTorr to 1 Torr. In some embodiments, the internal gas pressure ranges from 0.1 mTorr to 100 mTorr. In some embodiments, the internal gas pressure ranges from 1 mTorr to 60 mTorr. In some embodiments, the internal gas pressure ranges from 1 mTorr to 15 mTorr.

Another embodiment of the invention is a method of obtaining a mass spectrum comprising (a) providing a sample comprising an analyte, and an apparatus of the invention; (b) using the at least one source of ionized analyte of the apparatus to ionize the analyte if it is neutral or to change the ionization state of the analyte and introducing it into the mass analyzer of the apparatus; (c) sorting the analyte according to its m/z ratio; and (d) detecting analyte sorted according to its m/z ratio, thereby obtaining a mass spectrum.

Another embodiment of the invention is a method of obtaining a mass spectrum comprising (a) providing a sample comprising an analyte, and an apparatus of the invention; (b) using the at least one source of ionized analyte of the apparatus to ionize the analyte if it is neutral and introducing it into the mass analyzer of the apparatus; (c) sorting the analyte according to its m/z ratio; and (d) detecting analyte sorted according to its m/z ratio, thereby obtaining a mass spectrum; wherein the method further comprises performing collision-induced dissociation on the analyte prior to step (c).

Another embodiment of the invention is a method of obtaining a mass spectrum comprising (a) providing a sample comprising an analyte, and an apparatus of the invention; (b) using the at least one source of ionized analyte of the apparatus to ionize the analyte if it is neutral and introducing it into the mass analyzer of the apparatus; (c) sorting the analyte according to its m/z ratio; and (d) detecting analyte sorted according to its m/z ratio, thereby obtaining a mass spectrum; wherein the analyte is provided in a liquid or dissolved state, and step (b) further comprises changing the state of the analyte from liquid or dissolved to gaseous prior to introducing the analyte into the mass analyzer of the apparatus.

In some embodiments, detecting the analyte comprises generating and detecting secondary ions or electrons.

In some embodiments, detecting the analyte comprises direct detection of analyte charge.

In some embodiments, the analyte comprises a macromolecule, macromolecular complex, nanoparticle, or microparticle having a mass greater than $10^5$ Da, and the mass spectrum comprises a peak corresponding to the mass of the macromolecule, macromolecular complex, nanoparticle, or microparticle having a mass greater than $10^5$ Da.

In some embodiments, the analyte comprises a cell, spore, organelle, or virus, and the mass spectrum comprises a peak corresponding to the mass of the cell, spore, organelle, or virus.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

The foregoing aspects and advantages of this invention may become apparent from the following detailed description with reference to the accompanying drawings.

FIG. 6A is a picture of the prototype apparatus. Select components of this apparatus are illustrated schematically in FIGS. 1-2.), When combined with a data acquisition board as shown in FIG. 6B and an amplifier board as shown in FIG. 6C, this apparatus was the type used to acquire the data shown in FIGS. 4 and 5. The data acquisition and amplifier boards include a sweeping sine wave generator, sequence controller, voltage amplifier, and their accompanying interfaces (USB, DAC, ADC, and analog front end) and DC power supplies, as described below. The positions where these two printed circuit boards were installed after this photograph was taken are shown. The apparatus received power from a wall socket. The ruler shown for scale is in units of centimeters.

DETAILED DESCRIPTION OF THE EMBODIMENTS

A. Definitions

Figure 1:
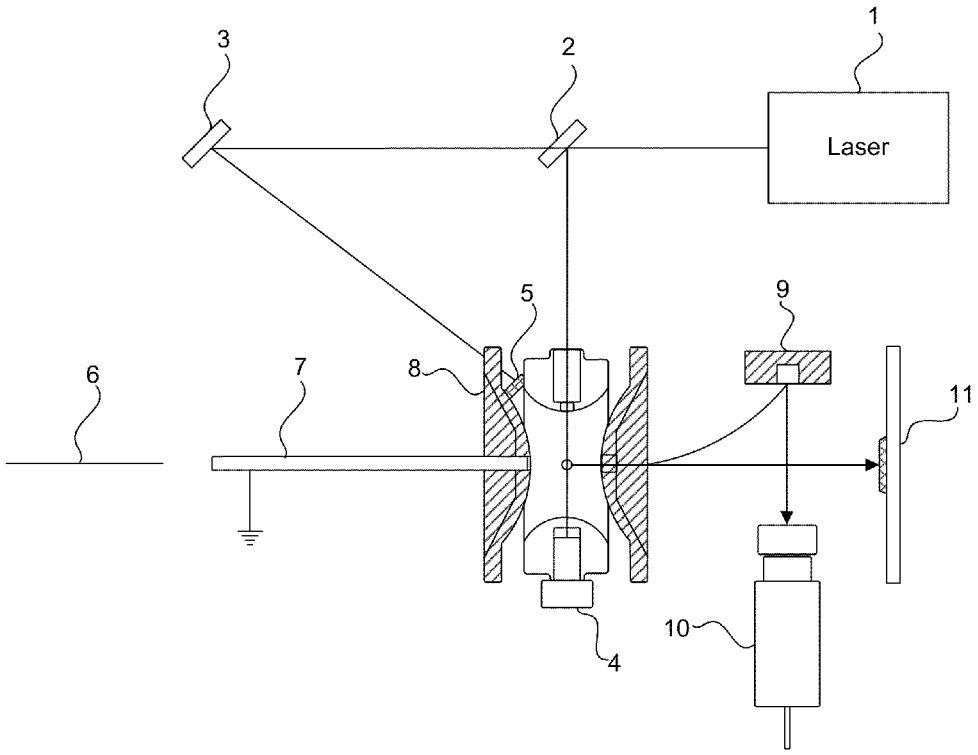
FIG. 1. Schematic of components of a portable multi-ionization source biological mass spectrometer. A laser 1 emits a beam directed toward two mirrors 2 and 3. Mirror 2 can either allow some laser light to pass through to mirror 3, or it can be switched to a position outside of the path of the laser light to allow access to mirror 3. Mirror 2, when in the path of the laser light, redirects the light to a matrix assisted laser desorption-ionization ("MALDI") plate 4. Mirror 3 redirects the light to a laser-induced acoustic desorption ("LIAD") plate 5. Plates 4 and 5, and an electrospray ionization ("ESI") source 6 and grounded steel capillary 7, can supply analyte to an ion trap mass analyzer 8. A conversion dynode 9 and channeltron 10 can detect analyte ejected from the mass analyzer 8 by charge amplification detection, and a charge detector 11 can detect analyte ejected from the mass analyzer 8 by direct charge detection.
Figure 2:
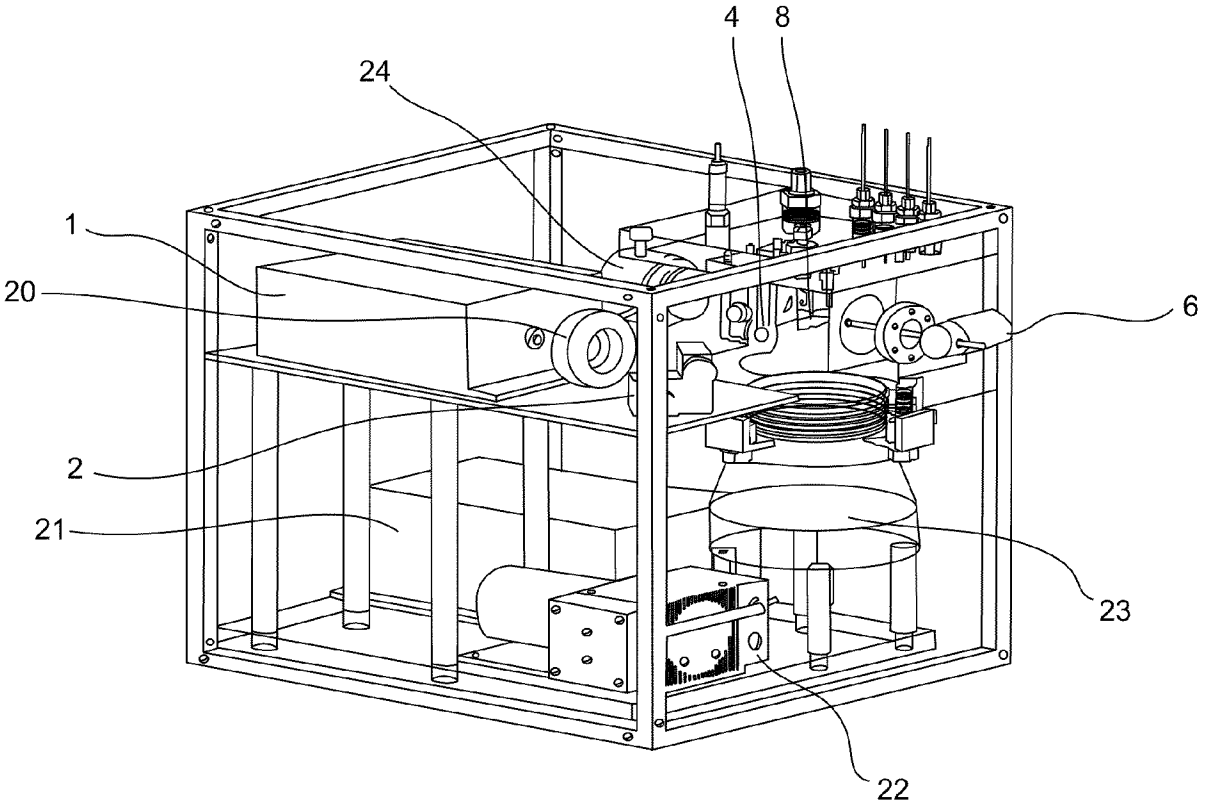
FIG. 2. Detailed design of a portable multi-ionization source biological mass spectrometer. In addition to the components of FIG. 1, shown are a lens mounting ring 20 for the laser 1; a power supply 21 for all powered components of the instrument; and a diaphragm pump 22, a turbo molecular pump 23, and a pressure gauge 24 for evacuation and pressure monitoring of the internal gas pressure in the mass analyzer 8.

To facilitate the understanding of this invention, a number of terms are defined below. Terms not defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

"Portable" as used herein means that a complete apparatus can be can be moved from one location to another, without disassembly or reassembly, e.g., by hand-carrying it, rolling it, moving it on a cart, by transporting it in a vehicle (such as a motorized vehicle), or by self-propelled means, and the apparatus can be used to obtain a mass spectrum of a sample in a non-laboratory setting, i.e., no building facilities other than possibly a power source are required for the apparatus to operate. Disassembly and reassembly do not include attaching and/or detaching external components such as power or data cables that connect the apparatus to external items such as a source of power or a laptop computer. "Human-portable" means that the apparatus can be carried (e.g., in a suitcase, backpack, or trunk) from one location to another, without disassembly or reassembly, by one or two people.

An apparatus comprises two "mechanistically different" sources of ionized analyte or detectors when the apparatus is configured to provide ionized analyte to a mass analyzer or detect ionized analyte sorted according to its m/z ratio by the mass analyzer in at least two different ways, e.g., MALDI and LIAD in the case of sources, or direct charge detection and charge amplification detection in the case of detectors. This does not necessarily mean that the sources or detectors are structurally different; for example, with MALDI and LIAD, the same laser, optics, and desorption plate can be used as a part of both sources, although the laser can be used with frequency doubling in LIAD, e.g., at a wavelength of 532 nm, while it can be used with frequency tripling in MALDI, e.g., at a wavelength of 355 nm. In some embodiments, the MALDI/LIAD laser can be switched from doubled to tripled mode and vice versa by manually exchanging a doubling and tripling crystal. In some embodiments, the instrument can automatically switch modes, e.g., by rotating the doubling or tripling crystal into or out of the beam path. In MALDI, the laser is directed to strike the side of the plate that the sample is placed on, and in LIAD, the laser is directed to strike the opposite side, possibly with increased laser fluence. The laser can be redirected by switching the optics to direct the laser beam appropriately. Mechanistically different sources or detectors are also "structurally different" if one of the sources or detectors comprises at least one component that is not used by the other source or detector. For example, if an apparatus comprises a LIAD source and a MALDI source that use different sample plates (but the same laser), they are structurally different. If an apparatus comprises a charge amplification detector that uses a conversion dynode and a channeltron, and a direct charge detector that uses the conversion dynode as a Faraday plate but does not use the channeltron, the detectors are structurally distinct.

A "small molecule" is a molecule that is not a macromolecule. Both small molecules and macromolecules can include uncharged and charged atoms or groups (i.e, a small molecule or a macromolecule can be an ion). "Macromolecules" include polymers, such as polysaccharides, polynucleotides, polypeptides, and adducts and combinations thereof.

B. Overview of the Apparatus

The apparatus is portable and comprises at least one source of ionized analyte, a mass analyzer, a frequency scanning subsystem, and at least one detector. The apparatus optionally comprises a vacuum pump. The at least one source of ionized analyte can provide ionized analyte obtained from a sample to the mass analyzer, which the frequency scanning subsystem can control to sort ionized analyte according to its m/z ratio so that it can be detected by the at least one detector. The detector can obtain data by interacting with the sorted analyte. A mass spectrum can be generated from the data obtained by the detector, e.g., by a computer contained within the apparatus, or an external computer that receives data from the apparatus. In some embodiments, the apparatus can be configured to obtain a mass spectrum of various types of analyte, for example, small molecules, nanoparticles, microparticles, macromolecules, macromolecular assemblies, spores, viruses, cells, and/or cellular components such as organelles.

In some embodiments, the apparatus is configured to obtain a mass spectrum of an analyte having a molecular weight of greater than or equal to $10^5$ Da and of an analyte having a molecular weight of less than or equal to 1,000 Da, or an m/z ratio of greater than or equal to $10^5$ and of an analyte having an m/z ratio of less than or equal to 1,000. Thus, the apparatus can generally analyze both small and large analyte. Such an apparatus provides versatile analytical capabilities in non-laboratory settings, e.g., for biological and nanotechnological samples, and facilitates the characterization of samples in a rapid manner at or near their place of origin. As the apparatus can analyze both larger and smaller analyte, such as small molecules, it is suitable for applications in which the contents of samples that may be encountered are unpredictable and/or can vary widely in mass.

In some embodiments, the apparatus comprises a first source of ionized analyte chosen from a MALDI source and a LIAD source and at least one additional source of ionized analyte mechanistically different from the first source of ionized analyte. The apparatus of these embodiments also provides versatile analytical capabilities in non-laboratory settings, in that a single apparatus is thus able to obtain mass spectra from the same or different samples using different sources of ionized analyte, and it is suitable for applications in which the contents of samples that may be encountered are unpredictable and/or can vary widely in chemical properties.

For example, a MALDI or LIAD source can provide analyte to the mass analyzer with a relatively low degree of fragmentation. Another, second source can be chosen so as to provide analyte to the mass analyzer with a greater degree of fragmentation, e.g., electron ionization electron capture ionization, or dissociative sources such as IR multiphoton dissociation or a source that performs collision induced dissociation. Low fragmentation can be useful with analyte such as macromolecules, cells, and/or mixtures of analyte, wherein fragmentation could result in an extremely complex and difficult to interpret spectrum. Higher fragmentation can be useful with relatively pure samples when structural information that can be obtained from fragment sizes is desired.

In some embodiments, the presence of at least two different sources of ionized analyte in the apparatus can expand the range of possible samples for which interpretable data, or high-quality data, can be obtained, e.g., to include both samples comprising high molecular weight analyte to which MALDI and LIAD are well-adapted, and samples where the analyte of interest is a small molecule and/or a photolabile substance that may be structurally altered by laser irradiation in MALDI or that may not ionize well when using a LIAD source.

C. Source of Ionized Analyte

The apparatus comprises a source of ionized analyte, which provides analyte to a mass analyzer in the gas phase in an ionized state. In some embodiments, the ion source can be configured to vaporize an analyte that is initially provided in solid or liquid form. The analyte can be initially charged, such as in the case of, for example, polyatomic ions. In some embodiments, the ion source is configured to ionize an analyte that is initially in a neutrally charged state and/or to change the ionization state of an analyte, such as by increasing the extent to which it is positively or negatively charged. In other embodiments, ion sources can additionally sort, purify, or fractionate analyte in addition to vaporization and/or ionization, such as, for example, ion sources comprising gas or liquid chromatographs.

Multiple sources of ionized analyte can be present in the apparatus. The ions produced are analyzed in a mass analyzer, such as an ion trap, quadrupole, or time of flight mass analyzer. They can all use the same mass analyzer for mass-to-charge-ratio (m/z) analysis. They can also all share the same detector system, which can comprise one or more than one detector.

The source of ionized analyte can include matrix-assisted Laser Desorption/Ionization (MALDI), Electrospray Ionization (ESI), Laser-Induced Acoustic Desorption (LIAD), desorption-electrospray ionization (DESI), direct analysis in real time (DART), low temperature plasma ambient ionization (LTP), ultrasound ionization (UI), electron impact ionization (EII) atmospheric pressure chemical ionization (APCI), electron ionization (EI), glow discharge electron ionization (GDEI), electron attachment (EA), infrared multiphoton dissociation (IRMPD), electron capture dissociation (ECD), and collision induced dissociation (CID). In some embodiments, the source of ionized analyte comprises at least one of a MALDI, LIAD, or ESI source, at least two of these types of sources, or all three of them. Additional modes of vaporization and ionization are also included within this invention. See, e.g., E. de Hoffmann and V. Stroobant, *Mass Spectrometry: Principles and Applications* (3rd Ed., John Wiley & Sons Inc., 2007).

In some embodiments, the apparatus comprises a MALDI sample plate configured to operate at ground voltage and/or at a voltage ranging from 1 to 30000 V or 100 to 500 V.

A compact laser (for example, a diode pumped Nd:YAG laser, such as the Spectra Physic model Explorer 349 OEM Diode-Pumped Solid State UV Laser) can be used to achieve ionization by MALDI and/or LIAD. In some embodiments, a higher laser fluence is used to perform LIAD than to perform MALDI.

Ions produced by the source of ionized analyte can be subsequently introduced to the mass analyzer, e.g., trapped in an ion trap, for mass analysis and/or molecule identification by various fragmentation processes, such as collision-induced dissociation.

In some embodiments, ionized analyte, such as that produced by an ESI source, can be introduced into the mass analyzer in a pulsed manner by briefly opening a pathway between the source and the analyzer, for example, by using a pinch valve. For example, a capillary, for example a 100 mm long and 0.1-0.5 mm-i.d. inlet stainless steel capillary, leading from the source toward the mass analyzer, can be coupled with a normally closed pinch valve, which can be controlled by an electric signal from a pulsed function generator. In this way, the path from the ionization source to the mass analyzer can be opened for a desired duration.

In some embodiments, ionized analyte from a source such as an ESI source can be continuously introduced into the mass analyzer. This includes, for example, introducing ionized analyte into the mass analyzer directly, wherein the spray tip is heated to prevent freezing, for example, with a heating power of about 0.5 W, 0.75 W, 1 W, or more.

In some embodiments, the apparatus is configured to operate in either a continuous or pulsed mode, e.g., by keeping a pinch valve open continuously or opening it in a pulsed manner. In some embodiments, the apparatus operates with a lower pressure in the mass analyzer in pulsed mode (e.g., 0.05-0.2 mTorr, such as about 0.09 mTorr) than in continuous mode (e.g., 5-15 mTorr, such as about 8 mTorr).

In some embodiments, the apparatus is configured to perform both MALDI and LIAD. LIAD can be achieved by guiding the laser beam to the back side of the sample plate. LIAD can be useful for desorption of particles with charges without need for further ionization, and can generate spectra with low amounts of analyte fragmentation. Cell and microparticles are examples. In some embodiments, neutral particles are produced, and a subsequent ionization process is performed, for example, by exposing the analyte to electron impact ionization or an electrical discharge, such as a glow discharge or corona discharge. See, e.g., Chen et al., U.S. Patent Application Publication No. 2009/0189059, published Jul. 30, 2009. LIAD can be achieved by shining the laser beam from the backside of the thin sample plate instead of shining the laser beam onto the sample for MALDI. LIAD and MALDI can be achieved in the same apparatus using the same laser by using a set of optics to direct the laser beam onto the front of one sample plate and the backside of another sample plate; see, e.g., FIG. 1. Alternatively, the optics could be configured to direct laser light onto either the front or back of the same sample plate.

In some embodiments, the instrument comprises a sample processing device that separates components in the sample prior to ionization and/or introduction into the gas phase by the source of ionized analyte. The sample processing device can be a chromatograph, for example, a nano-HPLC or other microfluidic liquid chromatography device.

D. Mass Analyzer

The apparatus comprises a mass analyzer. The mass analyzer can be chosen from various types of ion trap mass analyzers.

The mass analyzer can be controlled by purpose-built or commercially available electronic components. For example, components such as an ANALOG DEVICES AD5930 programmable frequency sweep and output burst waveform generator and an APEX PA94 sine wave amplifier can be used in generating the signal for frequency and/or voltage scanning by a quadrupole ion trap.

In some embodiments, the apparatus comprises an ion trap and is configured to acquire a mass spectrum by at least one of frequency scanning and voltage scanning. In some embodiments, the apparatus can acquire mass spectra by both of frequency scanning and voltage scanning, in separate runs. Frequency scanning can be useful for analytes with high m/z ratios. Voltage scanning can be useful to acquire high resolution spectra. Both frequency and voltage scanning operate by selectively ejecting ions from the ion trap, wherein the ejection results from the ions having an unstable trajectory due to the frequency or voltage during the scan, according to their m/z ratio. These ions are subsequently detected by a detector as described below.

The mass analyzer sorts analytes in space or time according to their mass-to-charge ratio and can use an electric and/or magnetic field to do so.

The analyte can be analyzed in an ion trap. This type of mass analyzer can subject the analyte to an electric field oscillating at a radio frequency (RF). In some embodiments, a DC bias is applied to the ion trap electrodes to perform instability mass selection and isolation. The DC bias can be, for example, about 2000 V. Ion traps can operate at relatively high gas pressures compared to most types of mass analyzers, and thus can allow reduction in the overall weight of the instrument, for example, by allowing the use of fewer or smaller vacuum pumps, or no vacuum pump, and consequently reducing the necessary battery size in the case of a battery-powered instrument. In some embodiments, the apparatus is configured to operate with an internal mass analyzer pressure that can be attained by one vacuum pump, or at ambient atmospheric pressure without a vacuum pump or with a vacuum pump that is turned off.

Various ion trap geometries are known in the art. See, e.g., E. de Hoffman and V. Stroobant, *Mass Spectrometry: Principles and Applications* (3$^{rd}$ Ed., John Wiley & Sons Inc., 2007) and Ouyang et al., *Annu. Rev. Anal. Chem.* 2:187-214 (2009). In some embodiments, the ion trap is of a type chosen from a quadrupole, linear, rectilinear, cylindrical, toroidal, and halo ion trap.

The ion trap can be a three-dimensional quadrupole ion trap, also known as a Paul Ion Trap, which can have end cap electrodes and a ring electrode. The end cap electrodes can be hyperbolic. The end cap electrodes can be ellipsoid. Holes can be drilled in the end cap electrodes to allow observation of light scattering and through which analyte can be ejected. The frequency of oscillation can be scanned to eject analyte from the trap according to its mass-to-charge ratio.

The ion trap can be a linear ion trap (LIT), also known as a two dimensional ion trap. The linear ion trap can have four rod electrodes. The rod electrodes can cause oscillation of analyte in the trap through application of an RF potential. An additional DC voltage can be applied to the end parts of the rod electrodes to repel analyte toward the middle of the trap. The linear ion trap can have end electrodes placed near the ends of the rod electrodes, and these end electrodes can be subject to a DC voltage to repel analyte toward the middle of the trap. Analyte can be ejected from the linear ion trap. Ejection can be accomplished axially using fringe field effects generated, for example, by an additional electrode near the trap. Ejection can be accomplished radially through slots cut in rod electrodes. The LIT can be coupled with more than one detector so as to detect analyte ejected axially and radially.

The size of an ion trap mass analyzer can be described in terms of a dimension $x_0$ (for linear or rectilinear ion traps) or $r_0$ and $z_0$ (for quadrupole, cylindrical, toroidal, and halo ion traps). See, e.g., Ouyang et al., *Annu. Rev. Anal. Chem.* 2:187-214 (2009). In some embodiments, the apparatus comprises an ion trap with an $x_0$ or $r_0$ value ranging from 1 μm to 30 mm, 20 μm to 25 mm, 500 μm to 20 mm, 5 mm to 15 mm, 1 mm to 30 mm, 1 mm to 25 mm, 2 mm to 20 mm, 2 mm to 15 mm, or 1 μm to 500 μm. In some embodiments, the apparatus comprises an ion trap with a $z_0$ value ranging from 1 μm to 30 mm, 20 μm to 25 mm, 500 μm to 20 mm, 5 mm to 15 mm, 1 mm to 30 mm, 1 mm to 25 mm, 2 mm to 20 mm, 2 mm to 15 mm, or 1 μm to 500 μm. In some embodiments, the apparatus comprises an ion trap with $r_0$ and $z_0$ values chosen to have an $r_0/z_0$ ratio ranging from 1.05 to 1.6, 1.1 to 1.5, 1.15 to 1.45, 1.2 to 1.42, 1.05 to 1.4, 1.1 to 1.4, or 1.25 to 1.35. In some embodiments, the ratio can be chosen to optimize the ideality of the field geometry, e.g., using a ratio of about $\sqrt{2}$ (approximately 1.414). This can help to maximize signal strength. In other embodiments, the ratio can be chosen to minimize the phenomenon of chemical shift, e.g., using a lower ratio, in which the $z_0$ dimension is relatively larger for a given $x_0$ value, e.g., 1.1 to 1.41, 1.15 to 1.4, 1.2 to 1.4, 1.05 to 1.4, 1.1 to 1.4, or 1.25 to 1.35. This can help to maximize accuracy of measured analyte m/z ratios and/or masses. See, e.g., Wells et al., *Anal. Chem.* 71:3405-3415 (1999).

In some embodiments, the mass analyzer comprises an array of ion traps with small dimensions, for example, an array of 256 cylindrical or linear ion traps having a dimension $r_0$ or $x_0$ ranging from 1 μm to 20 μm. Using a mass analyzer comprising an array of ion traps can result in a higher ion trapping capacity. See, e.g., Ouyang et al., *Annu. Rev. Anal. Chem.* 2:187-214 (2009).

E. Frequency Scanning Subsystem

The apparatus comprises a frequency scanning subsystem, which can generate, is capable of generating, and/or is configured to generate an oscillating field in the ion trap; the field has a frequency that varies over time during a scan, either in a stepwise manner or in a sweeping manner.

In some embodiments, the subsystem can generate a field with a sweeping frequency that moves smoothly through a range, e.g., a range comprising from 1,000,000 Hz to 100 Hz, from 200,000 Hz to 500 Hz, or from 10,000 Hz to 100 Hz. The duration of the scan can be, for example, a time ranging from 5 to 500 ms, or from 25 to 100 ms, such as 50 ms.

In some embodiments, the subsystem can generate a field with a series of frequencies stepped over time. The frequency is maintained at a value for a number of cycles, e.g., a number of cycles ranging from 2 to 50, or from 3 to 10, such as five cycles, and then is stepped to the next frequency. The length of a cycle in seconds is the reciprocal of the frequency; e.g., at 100 Hz, a cycle takes 0.01 seconds. For example, the frequency could be stepped from 10000 Hz to 100 Hz, with each step changing the frequency by a set number of Hz or by a relative proportion of the previous frequency. The set number could be, for example, a number ranging from 0.1 to 100 Hz, from 0.2 to 50 Hz, from 0.3 to 20 Hz, or from 0.5 to 5 Hz, such as 1 Hz. The proportion could be, for example, a proportion ranging from 1 to 100 parts per million, or from 10 to 20 parts per million, of the previous frequency.

The amplitude of the field can be held constant during frequency scanning, at a voltage sufficient to trap analyte of the desired m/z ratio. e.g., 200, 300, 350, 400, 450, 500, 550, 600, 700, 800, 900, 1000, 1100, 1200, 1300, 1400, or 1500 V. In some embodiments, the voltage is held constant to within a tolerance. The tolerance can be, for example, less than or equal to 1%, 0.5%, 0.25%, or 0.1%. Holding the amplitude constant can simplify the determination of the m/z ratio of ions ejected as a function of frequency, which can be determined using the Mathieu equation $q_z=8\,eV/(m\Omega^2(r_0^2+2z_0^2))$, where $q_z$ is analyte charge, e is the charge of an electron, V is the amplitude (in voltage) of the field, m is analyte mass, Ω is frequency at ejection of the analyte, and $r_0$ and $z_0$ are the trap dimensions for a 3D ion trap. Appropriate similar equations can be used for other trap geometries.

The frequency scanning subsystem can comprise a resonant electronic element with a tunable component that can generate RF signal with sweeping and/or stepped frequencies, for example, an LC circuit with a tunable inductor or capacitor, or a function generator. The tunable element can be tuned to sweep or step the frequency during a scan by, for example, adjusting the capacitance by changing the distance between elements of the capacitor, or by changing the length or cross-sectional area of an inductor coil. A stepping motor could be used to adjust the frequency by tuning a tunable element.

In some embodiments, the frequency scanning subsystem comprises a function generator, an operational amplifier, and a mass spectrometer sequence controller. The function generator can be a sweeping sine wave generator, also known as a frequency sweep waveform generator, or an arbitrary function generator. The function generator can comprise a voltage-controlled oscillator that produces sweeping frequencies. The function generator can comprise a Direct Digital Synthesis (DDS) circuit. The DDS circuit can comprise an electronic controller, memory, a source of reference frequency such as a crystal oscillator, a DAC, and a counter.

The function generator can be purpose-built or commercially acquired, for example, an ANALOG DEVICES AD5930 programmable frequency sweep and output burst waveform generator. An example of a suitable commercially available operational amplifier is an APEX PA94 sine wave amplifier.

In some embodiments, the apparatus comprises an electronic memory medium comprising instructions that, when executed, direct the frequency scanning subsystem to perform a sweeping or stepped frequency scan as discussed above. In some embodiments, said electronic memory medium is comprised by an external computer connected to the apparatus. In some embodiments, said instructions are comprised by an internal computer.

In some embodiments, the apparatus is accompanied by human-readable instructions for performing frequency scanning with the apparatus. Human-readable instructions include instructions that can be read with the aid of a computer. The instructions can be in paper (e.g., a manual or booklet) or electronic form (e.g., a file of any readable format contained on a CD-ROM, diskette, memory stick, or other digital storage medium; in the internal memory (e.g., ROM, NVRAM, or hard drive, of the apparatus or a computer accompanying the apparatus).

F. Detector

The apparatus comprises at least one detector, for example, a direct charge detector, a charge amplification detector, or a light scattering detector.

A direct charge detector operates to directly detect ions exiting the mass analyzer ("primary ions") and measures the total number of charges on the analyte. A direct charge detector has a relatively low noise level because the initial signal is generated via interaction with analyte without amplification, limiting the presence of background signal.

A charge amplification detector generates electrons or secondary ions by allowing the primary ions to contact a component that emits multiple electrons or ions as a result of such contact. This component can be, for example, a conversion dynode. A charge amplification detector can have greater sensitivity because the emission of the electrons or secondary ions amplifies the signal. In some embodiments, a DC bias of up to about 25 kV, for example, about 20 kV, is applied to the conversion dynode. In some embodiments, high dynode voltage such as voltage greater than 15 kV is combined with detection at pressures less than 0.1 mTorr, for example, 0.01-0.1 mTorr, in order to optimize sensitivity and minimize electronic noise. In other embodiments, a lower voltage for the dynode DC bias can be used with a higher pressure at detection in order to enhance portability and/or the duration for which the apparatus can operate without external power by minimizing features such as power consumption or weight (e.g., by allowing the use of a relatively smaller battery and/or fewer or smaller vacuum pump(s)).

A light scattering detector, such as a camera, e.g., a CCD camera, can be configured to detect light (e.g., laser light) scattered by analyte in the mass analyzer. See, e.g., W.-P. Peng et al., Angewandte Chemie Int. Ed., 45:1423-1426 (2006).

The at least one detector can be chosen from a direct charge detector such as a Faraday plate, a Faraday cup, or an induction charge detector; a charge amplification detector such as a microchannel plate (MCP), a microsphere plate, a electromultiplier, and a channeltron; and a light scattering detector. Commercially available detectors such as the BURLE 5900 channel detector are suitable for use in the instrument.

In some embodiments, the same component can be used in both charge detection and charge amplification detection. For example, a plate can be used as a Faraday plate for charge detection and as a conversion dynode plate for charge amplification detection. In such embodiments, the apparatus is configured to have multiple detection modes so that it can serially acquire spectra by charge detection and then by charge amplification detection, or vice versa.

Figure 3:
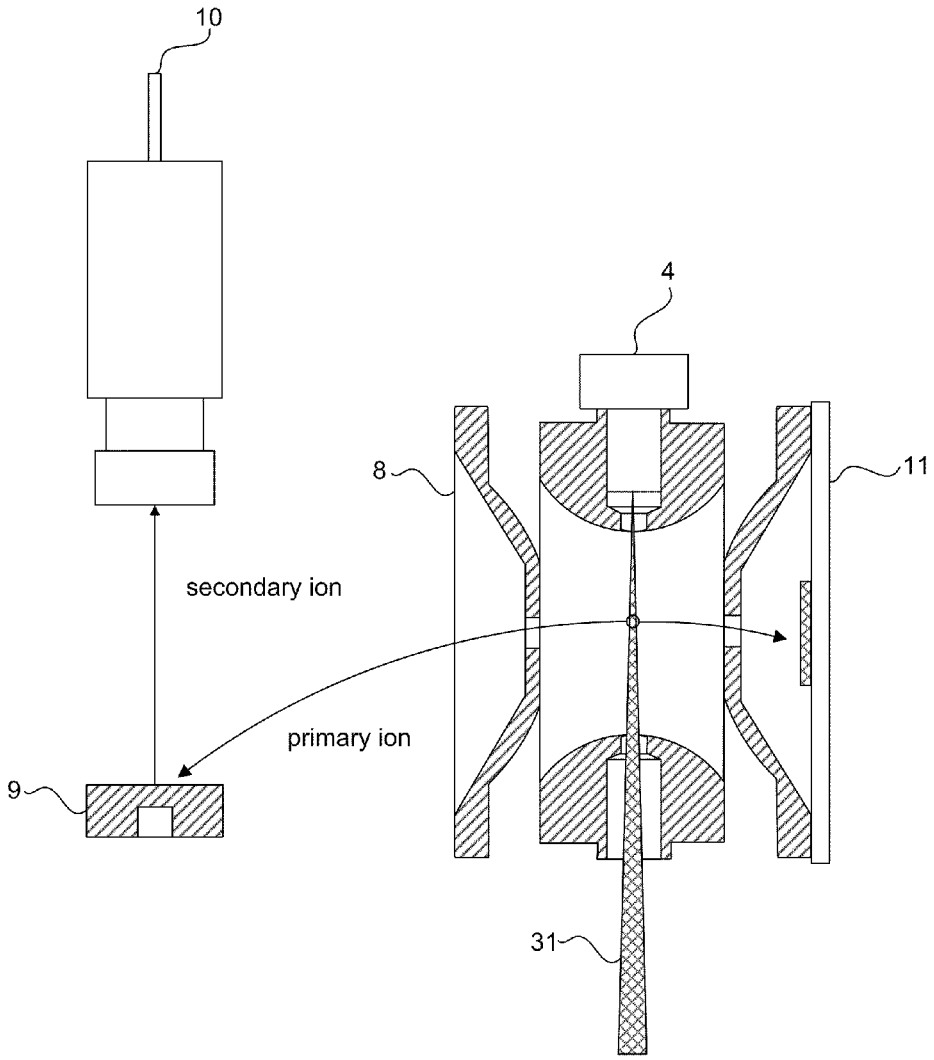
FIG. 3. Configuration of a charge detector and charge amplification detector at different mass analyzer exit ports for simultaneous charge detection and charge amplification detection of ejected analyte. A conversion dynode 9 and channeltron 10 positioned at a first exit port of the mass analyzer 8 can detect analyte ejected therefrom by charge amplification detection, and a charge detector 11 positioned at a second exit port of the mass analyzer 8 can detect analyte simultaneously ejected therefrom by charge detection. Also shown are the MALDI plate 4 and the incoming laser light path 31. The paths of primary and secondary ions involved in charge amplification detection are labeled.

In some embodiments, the apparatus comprises separate charge and charge amplification detectors which can operate simultaneously, for example, by being located at different exit ports of the mass analyzer. See, e.g., FIG. 3.

In some embodiments, the apparatus comprises two detectors, of which one does not contact the primary ion, for example, an induction charge detector. The induction charge detector can be a single-stage or multiple stage device that yields one or more measurements of the electric charge of an analyte. The induction charge detector can also yield measurements of the time of flight of the analyte through the stage or stages of the detector. The sensor can include one or more conductive tubes or plates. The tubes can be collinear and cylindrical, and have equal diameters. The plates can be arranged in parallel pairs. The entrance to the sensor can be a narrower tube that limits the number of entering particles, such as to one at a time, and ensures that their trajectories remain close to the cylindrical axis. As a charged particle enters each sensing tube, it induces a charge on the tube nearly equal to its own. Each sensing tube can be connected to an operational-amplifier circuit that senses the electric potential associated with the induced charge. The charge of the particle can be calculated from this electric potential and the capacitance of the tube. Induction charge detectors are described, for example, in "Induction Charge Detector With Multiple Sensing Stages" (Jan. 1, 2008) by NASA's Jet Propulsion Laboratory. The primary ion can thus pass through a detector that does not contact the primary ion and then contact a component of a charge amplification detector to generate electrons or secondary ions as described above.

Information about the analyte can also be obtained by molecular imaging. To perform molecular imaging of a sample, either the sample is mounted on a micrometer controlled plate or a laser beam is guided by changing the laser light path with a micrometer to adjust the optical components such as mirrors and lenses to direct the laser into the mass analyzer to illuminate analyte. An image acquisition device such as a CCD camera can be used to acquire images derived from illuminated analyte, which can give light scattering and oscillation information. See, e.g., Peng et al., *Angew. Chem. Int. Ed.* 45:1423-1426 (2006). In some embodiments, a laser is used that is capable of high speed molecular imaging, e.g., by operating with a repetition rate of about 1000 Hz and a beam diameter of about 20 μm.

G. Vacuum Pump and Operating Pressure

The apparatus of the invention can be operated with the interior of the mass analyzer under reduced air pressure relative to the atmosphere or at ambient atmospheric pressure, and the gas present in the mass analyzer (optionally at reduced pressure) can be chosen from, for example, air, nitrogen, helium, argon, sulfur hexafluoride, neon, and xenon. The reduced pressure can be provided by at least one vacuum pump. In some embodiments, a first pump such as a diaphragm pump or a scroll pump is coupled with a second pump such as a turbo molecular pump. In some embodiments, a single vacuum pump is used, such as a scroll pump or diaphragm pump. In some embodiments, the apparatus operates in the absence of a supply of a rare or inert gas. In some embodiments, the apparatus does not comprise a vacuum pump, or comprises at least one vacuum pump and can operate in at least one low-power mode in which vacuum pump usage is reduced or eliminated. In the at least one low-power mode, the at least one vacuum pump can be operated at a lower rate to provide an intermediate reduction of pressure relative to the vacuum produced by full-power operation of the at least one pump. When the apparatus comprises more than one vacuum pump, it can be possible for the apparatus to operate in at least one low-power mode in which at least one of the pumps is operated at less than full capacity.

In some embodiments, the apparatus operates with an internal mass analyzer gas pressure ranging from 0.01 to 100 mTorr, for example, 0.1 to 50 mTorr, 0.2 to 40 mTorr, 0.5 to 30 mTorr, 1 to 15 mTorr, 1 to 30 mTorr, 1 to 40 mTorr, 1 to 50 mTorr, 1 to 60 mTorr, 1 to 75 mTorr, or 1 to 100 mTorr. In some embodiments, the apparatus is configured to operate with an internal mass analyzer gas pressure greater than 1, 5, 10, 15, 20, 25, 30, 40, 50, 60, 75, or 100 mTorr.

In some embodiments, the apparatus operates with a pressure of one atmosphere or ambient atmospheric pressure. This can be useful to extend battery life and/or reduce the weight and size of the apparatus. The sensitivity with which the apparatus detects analyte can be reduced by operation at atmospheric pressure due, for example, to the increased noise from interaction of the gas with the detector. This loss of sensitivity can be mitigated by using a light scattering detector, which can be less affected by the gas pressure than other detector types. Light scattering detectors can be effective with larger analyte, for which light scattering is generally greater than for smaller analyte.

In some embodiments, the apparatus comprises an electrospray ionization source and operates via pulsed mode electrospray ionization. The length and frequency of sample input pulses can be controlled by opening and closing an aperture, e.g., using a pinch valve or ball valve between the source and the mass analyzer. An example of a suitable pinch valve is a 2-way, normally closed pinch valve that is opened by a 24 V DC signal. An example of a suitable ball valve is a Swagelok electric actuator 1/16" ball valve. Pulsed mode operation can allow the at least one vacuum pump to reduce the internal gas pressure in the mass analyzer to a lower level when the aperture is closed than is possible when the aperture is open. Alternately, the source can inject the sample directly into the vacuum chamber of the mass analyzer for subsequent manipulation, e.g., sorting analyte by m/z ratio, such as voltage scanning, frequency scanning, or measurement of time of flight. In some embodiments, the apparatus can operate in a continuous sample introduction mode, e.g., to allow for more rapid sampling and data acquisition. In some embodiments, the apparatus can be switched between pulsed and continuous sample introduction modes to suit a user preference, e.g., for higher resolution and/or lower noise data, or more rapid sampling and data acquisition.

H. Control and Communications

In some embodiments, the instrument comprises a built-in computer, including various elements such as a microprocessor, display, interface, bus, and memory. The memory can comprise volatile (e.g., RAM) and non-volatile memory (e.g., ROM, a hard drive, NVRAM, or removable storage media). Signals obtained from the direct charge detector and/or the charge amplification detector can be analyzed using software which can be encoded or installed in the memory. The interface can include, for example, human interface devices, for example, a keyboard or keypad, touchpad, touch screen, or trackball; terminals or ports for human interface devices such as a mouse, joystick, or external keyboard or touch screen; and transmitters, receivers, and transceivers for wireless versions of any of the above devices. In some embodiments, interface components are multipurpose interfaces, for example, USB ports, serial ports, SCSI ports, parallel ports, IEEE1394 ports, or the like, which can connect to human interface devices, external memory, computers, power sources, and the like.

In some embodiments, the instrument comprises a wireless or wired interface for connection to an external computer, which comprises operating software to control the instrument, data analysis software to generate and/or plot mass spectra, and/or at least one human interface device to allow a user to operate the instrument and/or view or retrieve data acquired by the instrument. In some of embodiments, some of the above functions are performed by an internal computer in the apparatus and others are performed by an external computer which communicates with the apparatus.

I. Mass and Composition

In some embodiments, the apparatus of the invention has a total weight less than 100, 90, 80, 70, 60, 50, 45, 40, 35, 30, 25, 20, 15, 10, 7, 5, or 4 kg.

In some embodiments, the mass analyzer comprises a vacuum chamber composed of at least 50%, 60%, 70%, 80%, 90%, 95%, 99%, or 99.9% by weight of non-metal materials, for example, plastics such as poly(methyl methacrylate) (e.g., LUCITE™), polypropylene, polycarbonate, or polyvinylchloride. In some embodiments, the material of which the vacuum chamber is composed has a vapor pressure of less than 100, 50, 25, 20, 15, 10, 5, 2, 1, 0.5, 0.2, 0.1, 0.01, or 0.001 mTorr. Vapor pressure can be determined at 25° C. according to the method of Jensen, *J. Appl. Phys.* 27:1460-1462 (1956; "Jensen"). In some embodiments, the material of which the vacuum chamber is composed has a vapor pressure ranging from $10^{-2}$ to $10^{-5}$ mTorr. See, e.g., Jensen at Table 1. In some embodiments, it is possible to use such a non-metal vacuum chamber because of the ability of the apparatus to operate at relatively high pressures. In some embodiments, the vacuum chamber comprises a transparent plastic such as polycarbonate or poly(methyl methacrylate) and it is possible to observe the vacuum chamber interior by eye.

In some embodiments, the vacuum chamber is primarily non-metal with a metal coating. The metal can be a light weight metal, such as aluminum or titanium. In some embodiments, the vacuum chamber is composed primarily of a metal, which can be a light weight metal, such as aluminum or titanium.

J. Power Source

In some embodiments, the power consumption of the instrument is less than 500, 400, 300, 200 W, or 150 W, for example about 150 W or about 100 W. In some embodiments, the instrument uses a power source such as DC power, for example, from a generator or from an internal or external battery or batteries, which may be rechargeable, including automobile batteries, batteries suitable for portable electronics (e.g., lithium ion batteries such as those commonly used with laptop computers); or AC power, such as from a generator with a transformer or wall socket. The power source can be a portable non-battery source, for example, solar power, such as from a photovoltaic cell; power from a fuel cell; or power from a human-powered device, e.g., an electrical generator fitted with a hand crank or foot pedal.

K. Mass Spectrometer Capabilities and Configurations

In some embodiments, the apparatus is configured to measure analyte charge and mass-to-charge ratio (m/z ratio) at the same time. In some embodiments, the analyte charge measurement is a measurement of net charge of a group of ions for which the individual charge is known (for example, the individual ions have the same charge, which is chosen from −1, +1, −2, +2, −3, +3, etc.), and this measurement can be used to obtain the quantity of the species of ion. In some such embodiments, the analyte is a small molecule with a molecular mass less than 2000, 1500, 1000, 750, 500, 400, 300, or 200 Da.

In some embodiments, the apparatus is used to measure the charge and m/z ratio of an individual analyte species. From these data, the mass of the individual analyte species can be obtained.

The apparatus can comprise an ion trap which can perform MS with analyte with a high m/z ratio or molecular weight, e.g., an m/z ratio of at least $10^5$, $10^6$, $10^7$, $10^8$, $10^9$, $10^{10}$, $10^{11}$, $10^{12}$, or a molecular weight of at least $10^5$, $10^6$, $10^7$, $10^8$, $10^9$, $10^{10}$, $10^{11}$, $10^{12}$, $10^{13}$, $10^{14}$, $10^{15}$, or $10^{16}$ Da. Thus the portable apparatus can perform MS on high m/z ratio analyte or high molecular weight analyte with a relatively soft vacuum, as discussed above. An indication that the apparatus can perform MS with analyte having a molecular weight or m/z ratio of at least a certain value does not imply that the apparatus cannot also perform MS with smaller analyte, such as small molecules. It is generally the case that the apparatuses of the invention can perform MS with both small and large analyte. For example, in some embodiments, the apparatus can perform MS with analyte having a molecular weight less than or equal to 100, 500, 1,000, 5,000, or 10,000 Da, or with analyte having an m/z ratio less than or equal to 100, 500, 1,000, 5,000, or 10,000. This capability can be in addition to the capability to analyze larger analyte as discussed above.

In some embodiments, the apparatus has a modular construction and at least one, at least two, or more ionization modules are provided each comprising different sources of ionized analyte. For example, at least two modules can be provided that individually comprise sources chosen from MALDI, LIAD, and ESI sources. Depending on the desired application, the appropriate module can be installed. Also, a user can expand the capability of the instrument by acquiring an additional module. On the other hand, when desired, the weight and the cost of the instrument can be reduced by using fewer modules. Such a modular nature can also be more convenient should repair become necessary.

In some embodiments, an ESI source of ionized analyte is combined with at least one of a MALDI or a LIAD source. An apparatus comprising this combination of sources can be used to measure a very broad mass range with an ion trap compatible with analyte with a high m/z ratio. The construction costs of such an apparatus can be significantly less than that of two separate instruments, one for MALDI-TOF mass spectrometry and another for ESI-ion trap mass spectrometry.

In some embodiments, the apparatus comprises at least two different ion detectors, for example, a direct charge detector and an amplifying secondary electron ejection detector. In some embodiments, each detector is mounted on an assembly module. As with the ionization modules, either a selected detector module or multiple detector modules can be installed, depending on weight, cost, and capability considerations.

In some embodiments, the apparatus has a dynamic range of at least 1,000, at least 5,000, or a dynamic range that ranges from 1,000 to 10,000. Dynamic range refers to the ratio of the largest and smallest signals that can be detected in the same spectrum. In some embodiments, the dynamic range can be extended through tandem mass spectrometry, e.g., to $10^6$ or $10^7$. In some embodiments, the overall mass range (i.e., the minimum and maximum possible measured mass, not necessarily in the same spectrum) of the apparatus ranges from about 10 Da or about 100 Da to about $10^{15}$ Da or about $10^{16}$ Da. In some embodiments, the resolution of a mass spectrum obtained by the apparatus, expressed as $m/\Delta m$, that is, the ratio of the measured mass m to the peak width at half maximum $\Delta m$, ranges from about 500 to 2,000, for example, about 1,000, for small molecules; from about 50 to about 100 for analyte of about a mass of 100 kDa; and/or about 4 for analyte of about a mass of $10^{16}$ Da.

L. Mobile, Motorized, Autonomous, and/or Remote Controlled Embodiments

In some embodiments, the apparatus is mobile. Mobility can be conferred by the presence of at least one motor and wheels, treads, legs, hover fan(s), helicopter blades, propellers, wings, etc., including combinations of the foregoing. The apparatus can additionally comprise a receiver that allows the movement of the apparatus to be remotely controlled. The apparatus can additionally comprise a sensor, e.g., a camera, microphone, global positioning system (GPS), thermometer, altimeter, barometer, light sensor, etc., and a transmitter that enables information about its position and/or surroundings to be transmitted wirelessly. The apparatus can additionally comprise an artificial intelligence system that enables the apparatus to navigate autonomously, for example, over rough terrain, toward a designated geographical location, and/or toward a site that matches designated parameters of temperature, pressure, height, albedo, or the like. The apparatus can additionally comprise a sampling system that obtains a sample from its surroundings and provides it to the at least one source of ionized analyte. In some embodiments, the sampling system processes the sample prior to providing it to the source of ionized analyte, e.g., by pulverizing, purifying, dissolving, or vaporizing it.

Mobile, remote controlled, and/or autonomous embodiments can be useful in hazardous situations where the safety of a human operator would be endangered in the vicinity of or by proximity to a sample, e.g., when the sample is toxic, radioactive, infectious, or potentially so, is near such materials, or is located in an extreme environment. Mobile, remote controlled, and/or autonomous embodiments can also be useful in situations where the sample is in a location difficult for a human operator to reach, e.g., in a cave, deep underwater, in outer space, or on another planet or other astronomical body. Mobile, remote controlled, and/or autonomous embodiments can also be useful to survey or sweep an area repeatedly with no or minimal human intervention, e.g., to test for the presence of various compounds or particles over time at multiple locations with a single apparatus or a smaller number thereof than would be needed if said apparatuses were not mobile.

M. Methods and Applications

In some embodiments, the invention provides methods of obtaining at least one mass spectrum using a portable apparatus. The methods can comprise providing a sample and an apparatus as described above; using the at least one source of ionized analyte of the apparatus to ionize the analyte if it is neutral, and introducing it into the mass analyzer of the apparatus; sorting the analyte according to its m/z ratio; and detecting analyte sorted according to its m/z ratio, thereby obtaining a mass spectrum.

In some embodiments, the methods comprise performing a frequency scan of the analyte with an apparatus having a mass analyzer comprising an ion trap. The frequency scan can comprise scanning over a frequency range including frequencies such as 100, 150, 200, 500, 1,000, 2,000, 5,000, and 10,000 Hz. In some embodiments, at least two scans are performed at different scanning speeds and/or over different frequency ranges, e.g., in order to obtain information over a broader mass range at appropriate resolutions. For example, a scan could be performed at higher resolution at frequencies corresponding to a mass range of 100 to 10,000 Da and at a lower resolution but broader range of 10,000 to 1,000,000,000 Da. In some embodiments, the methods comprise performing a voltage scan of the analyte with an apparatus having a mass analyzer comprising an ion trap. In some embodiments, the methods comprise performing a frequency scan over a first range to obtain a first spectrum, then selecting a region of the first spectrum and performing a second scan, which can be a voltage scan, to obtain a second spectrum, which can have a higher resolution, for the selected region.

In some embodiments of the methods, the sample comprises an analyte with a molecular weight of at least $10^5$, $10^6$, $10^7$, $10^8$, $10^9$, $10^{10}$, $10^{11}$, $10^{12}$, $10^{13}$, $10^{14}$, $10^{15}$, or $10^{16}$ Da or an m/z ratio of at least $10^5$, $10^6$, $10^7$, $10^8$, $10^9$, $10^{10}$, $10^{11}$, or $10^{12}$, and the mass spectrum comprises a peak corresponding to a molecular weight of at least $10^5$, $10^6$, $10^7$, $10^8$, $10^9$, $10^{10}$, $10^{11}$, $10^{12}$, $10^{13}$, $10^{14}$, $10^{15}$, or $10^{16}$ Da or an m/z ratio of at least $10^5$, $10^6$, $10^7$, $10^8$, $10^9$, $10^{10}$, $10^{11}$, or $10^{12}$.

In some embodiments, using the at least one source of ionized analyte of the apparatus to ionize the analyte if it is neutral, and introducing it into the mass analyzer of the apparatus comprises ionizing the analyte or changing the ionization state of the analyte. In some embodiments, the analyte is provided in a liquid or dissolved state, and the method comprises changing the state of the analyte from liquid or dissolved to gaseous prior to introducing the analyte into the ion trap of the apparatus.

In some embodiments, the methods comprise performing collision-induced dissociation on the analyte prior to sorting the analyte according to its m/z ratio. These embodiments can further comprise selecting analyte of a specific m/z ratio, e.g., by ejecting analyte with undesired ratios prior to performing collision-induced dissociation. This is a form of tandem mass spectrometry.

In some embodiments, detecting the analyte comprises generating and detecting secondary ions or electrons, direct charge detection of the analyte, or both.

In some embodiments, the mass analyzer of the apparatus comprises an ion trap, and during the sorting of the analyte according to its m/z ratio, such as voltage or frequency scanning, the ion trap has an internal gas pressure such as an internal gas pressure ranging from 0.01 to 100 mTorr, for example, 0.1 to 50 mTorr, 0.1 to 100 mTorr, 0.2 to 100 mTorr, 0.2 to 50 mTorr, 0.2 to 40 mTorr, 0.5 to 30 mTorr, 1 to 15 mTorr, 1 to 30 mTorr, 1 to 40 mTorr, 1 to 50 mTorr, 1 to 60 mTorr, 1 to 75 mTorr, or 1 to 100 mTorr. In some embodiments, during the sorting of the analyte according to its m/z ratio and/or voltage or frequency scanning, the apparatus operates with an internal mass analyzer gas pressure greater than 15, 20, 25, 30, 40, 50, 60, 75, or 100 mTorr. In some embodiments, the apparatus operates with an internal mass analyzer gas pressure greater than 0.1, 0.2, 0.3, 0.4, 0.5, 0.6, 0.7, 0.8, or 0.9 atmospheres, or with a gas pressure at ambient atmospheric pressure.

In some embodiments, the analyte is trapped at a relatively higher pressure, such as ambient atmospheric pressure or a pressure ranging from 0.1 to 1 atm, 0.1 to 100 mTorr, 0.2 to 100 mTorr, 0.2 to 50 mTorr, 0.2 to 40 mTorr, 0.5 to 30 mTorr, 1 to 15 mTorr, 1 to 30 mTorr, 1 to 40 mTorr, 1 to 50 mTorr, 1 to 60 mTorr, 1 to 75 mTorr, or 1 to 100 mTorr, and frequency and/or voltage scanning is performed at a lower pressure, e.g., a pressure ranging from 0.01 to 0.1 mTorr, 0.01 to 0.15 mTorr, 0.02 to 0.1 mTorr, 0.02 to 0.15 mTorr, 0.05 to 0.1 mTorr, or 0.05 to 0.15 mTorr. This can minimize the phenomenon of chemical mass shift; see, e.g., Wells et al., *Anal. Chem.* 71:3405-3415 (1999). This can also reduce the amount of noise, such as electronic noise, registered by the detector.

In some embodiments, the methods comprise providing an apparatus comprising at least two sources of ionized analyte, as described above. These methods can further comprise obtaining mass spectra from analyte provided to the mass analyzer using at least two sources of ionized analyte, e.g., MALDI and ESI, LIAD and ESI, etc.

In some embodiments, the methods comprise obtaining at least one mass spectrum from a sample in a non-laboratory setting, such as in a mobile setting such as a vehicle, for example, a car, van, bus, helicopter, hovercraft, boat, plane, submarine, etc.; in a simple structure such as a tent or other shelter; in a residential, commercial, or industrial non-laboratory building where chemical or biological analytical procedures are not routinely performed, such as a residence, school, restaurant, shop, office, factory, power plant, or the like; or an outdoor setting. The at least one mass spectrum can be obtained in a manner independent of any building facilities, or independent of any building facilities other than a power source. In some embodiments, the methods comprise characterizing or identifying a sample comprising at least one analyte such as a small molecule, macromolecule, macromolecular complex, virus, cell, spore, microparticle, or nanoparticle in such a setting or manner.

In some embodiments, the methods comprise determining whether at least one indicium of a disease is present in a sample from an animal (including a human), plant, or other organism; the indicium of a disease can include, for example, metabolites, cells, cellular components, proteins, or other small molecules, macromolecules, or particles associated with a disease, including infectious agents such as pathogenic bacteria, archaea, spores (eukaryotic and prokaryotic), viruses, prions, or toxins; components or metabolites thereof; or cancerous or precancerous cells, or components or metabolites thereof.

In some embodiments, the methods comprise determining or characterizing the origin or composition of a sample, such as a forensic sample. This can be achieved by determining the presence or absence of at least one analyte in the sample, wherein the presence or absence of the analyte in the sample allows findings to be made about at least one attribute of the sample, such as the age, identity, or origin (e.g., in the case of biological samples, the species, sex, ethnicity, blood type, age, health or disease condition, genotype, phenotype, etc., of the organism from which the sample originated) of the sample.

In some embodiments, the methods comprise identifying or characterizing molecules or particles present in a gas. The gas can be atmospheric air. For example, volatile organic compounds, pollutants, impurities, toxins, pollen, spores, and other components relevant to the quality, purity, breathability, suitability for an industrial, medical, or research application, or safety of the gas can be detected. In some embodiments, the methods comprise installing the apparatus in a location for long-term monitoring of the molecules or particles present in a gas such as an air supply of a building, vehicle, underground area, or other enclosure, or the atmosphere in a geographic area, such as a city, town, municipality, etc., or subsection thereof.

EXAMPLES

The following specific examples are to be construed as merely illustrative, and not limitative of the remainder of the disclosure in any way whatsoever. Without further elaboration, it is believed that one skilled in the art can, based on the description herein, utilize the present invention to its fullest extent.

Example 1

Construction of a Portable Mass Spectrometer

A portable mass spectrometer was constructed using synthetic poly(methyl methacrylate) materials for the vacuum chamber. The instrument contained a KNF diaphragm pump and an Alcatel turbo molecular pump to provide vacuum. All components of the instrument were contained within a casing of length 30 cm, height 28 cm, and width 25 cm. The total mass of the instrument was about 16 kg. This mass spectrometer could measure m/z ratios ranging from about 500 to about two million. The apparatus comprised an ion trap with dimensions of $r_0$=10 mm and $z_0$=7.07 mm. A schematic design showing components of the instrument is shown in FIG. 1, except that the instrument did not contain the mirror 3 or the LIAD plate 5. The apparatus was powered using a wall socket.

Two DC power supplies (Matsusada Precision Inc., model S3-25N and S3-25P) provided ±25 kV to a conversion dynode. Another DC power supply (Matsusada Precision Inc., model S1-5N) supplied −2 kV to a charge amplification detector. Still another DC power supply (Matsusada Precision Inc., model S1-5P) supplied 2 kV to an electrospray ionization source. All DC power supplies were controlled by a home-made D/A converter. A pulsed laser beam with a wavelength of 355 nm from the tripling of a compact photodiode pumped Nd:YAG laser was used in the instrument as the laser light source for MALDI. The laser energy per pulse was about 120 μJ.

Figure 6A:
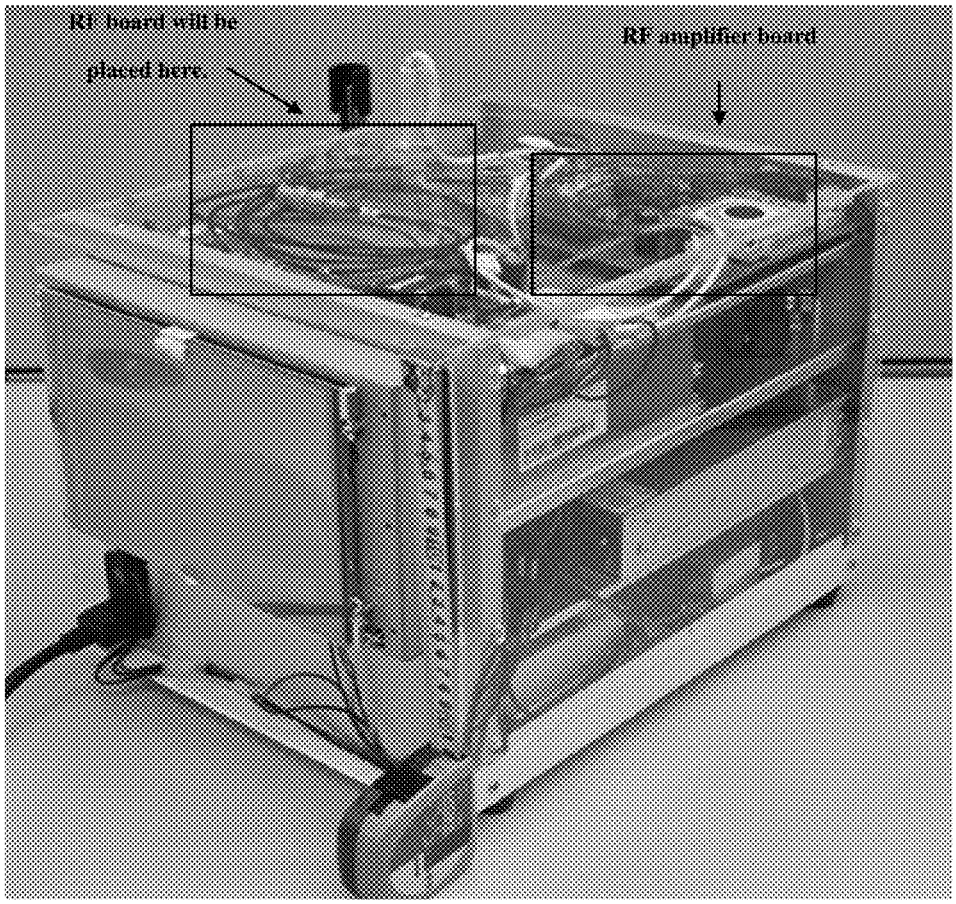
FIG. 6A. Prototype apparatus. A prototype apparatus was constructed before the data acquisition board and amplifier board were available.
Figure 6B:
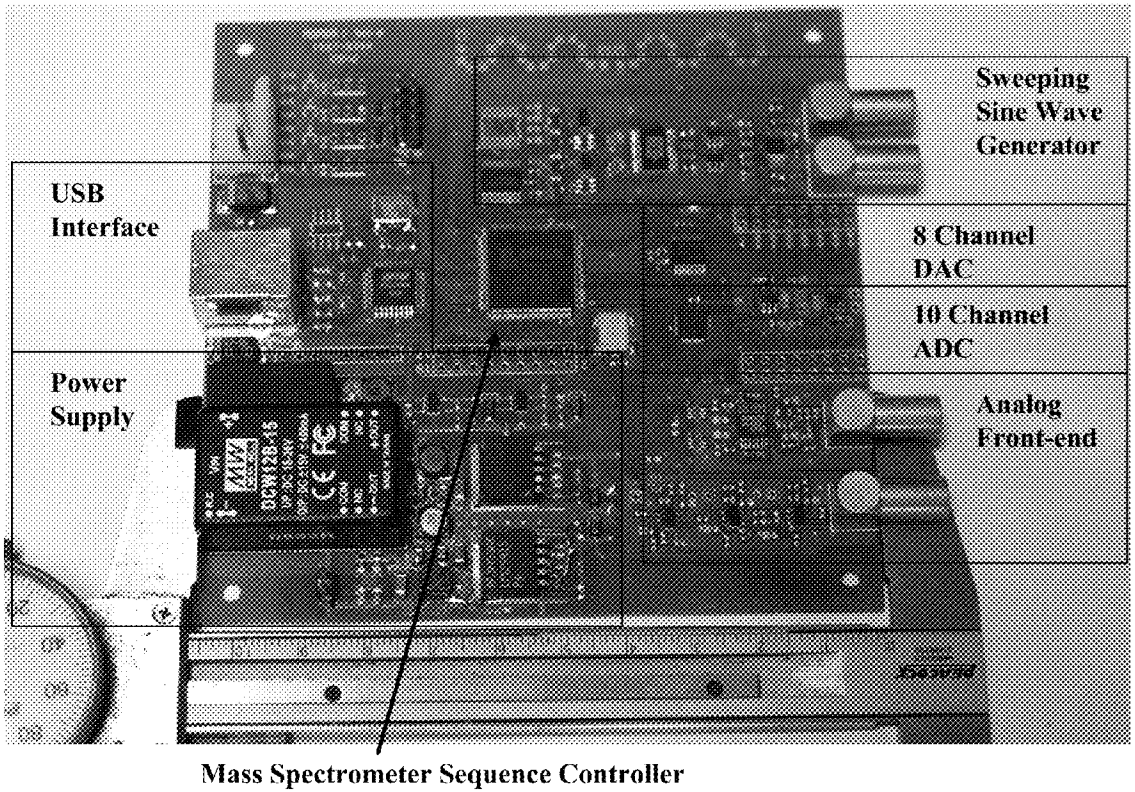
FIG. 6B. Data acquisition board. Shown is a photograph of a printed circuit board containing electronic components for portable mass spectrometer control. The board contained a sequence controller, sweeping sine wave generator, 8-channel digital to analog converter (DAC), 10-channel analog to digital converter (ADC), analog front end, universal serial bus (USB) interface, and DC power supply. The analog front end included a channeltron amplifier and pulse holder and a charge detector pulse holder. The ruler shown for scale is in units of centimeters. Together with an amplifier board as shown in FIG. 6C and the prototype apparatus of FIG. 6A, this board was used to construct a portable mass spectrometer.

The portable mass spectrometer included a data acquisition board essentially as shown in FIG. 6B. The board was about 11 cm×11 cm. The board controlled the ion trap RF field using a mass spectrometer sequence controller chip and sweeping sine wave synthesizer circuit, which is a home-made arbitrary function generator that generated the sine wave signal input to the ion trap mass analyzer. The synthesizer circuit was linked to the high voltage operational amplifier discussed below. Upstream control of the mass spectrometer sequence controller chip and sweeping sine wave synthesizer circuit was via a USB interface or general purpose digital input/output interface which can be connected to a computer. The data acquisition board further comprised an analog front end and a power supply for the board components.

Figure 6C:
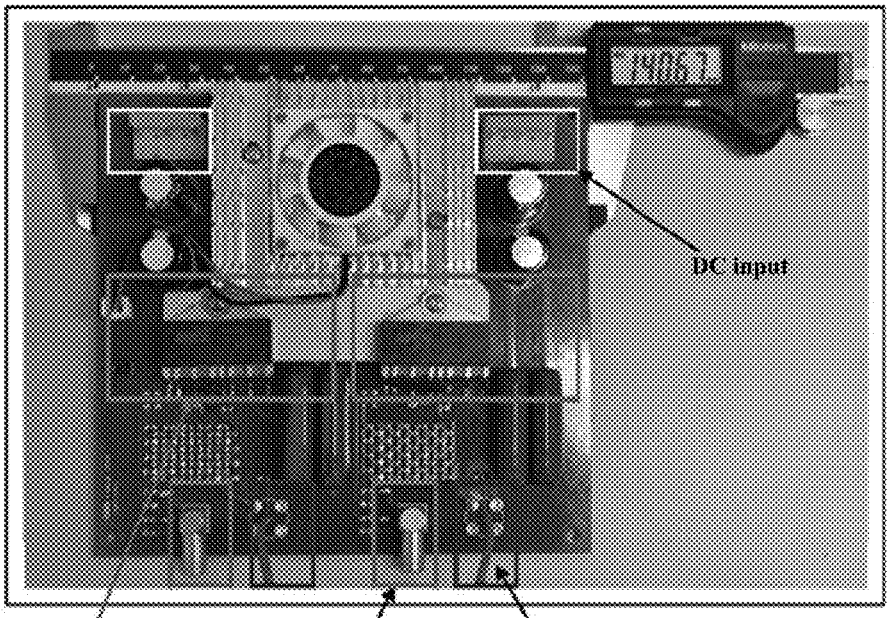
FIG. 6C. Amplifier board. Shown is a photograph of a printed circuit board containing equipment for high voltage amplification of the RF signal from the circuit board of FIG. 6B. The amplifier board contains two each of a DC input, an operational amplifier (OP amplifier), an RF input, and an RF output; one of each of these is labeled. The digital readout of the ruler shown for scale displays units of millimeters.
Figure 7A:
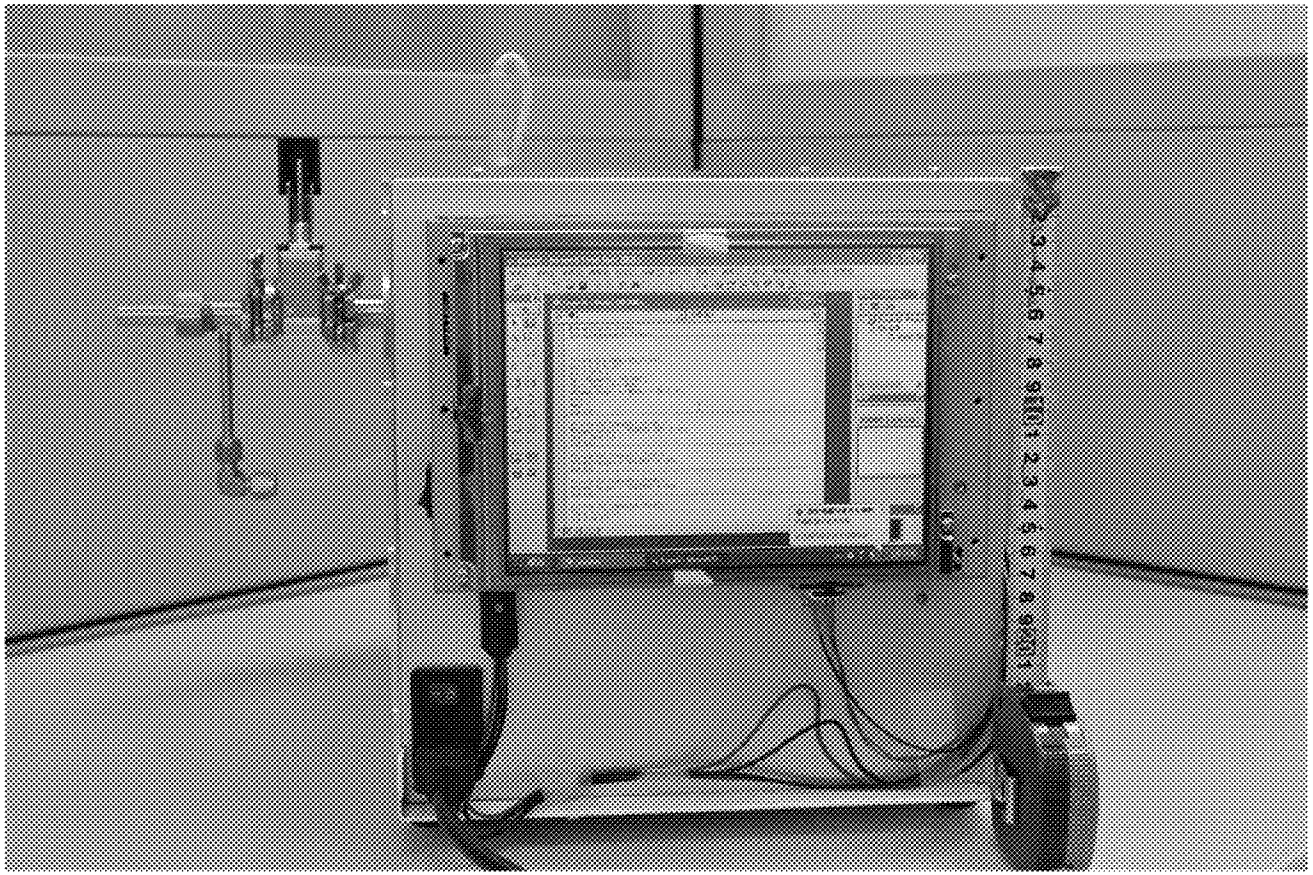
FIG. 7A-7F. Prototype instrument shown in multiple views, prior to addition of the data acquisition board of FIG. 6B and amplifier board of FIG. 6C. The same prototype as in FIG. 6A is shown at various angles. The prototype has a 7" LCD display which is activated in FIG. 7A. The ruler shown for scale in some panels is in units of centimeters.
Figure 7B:
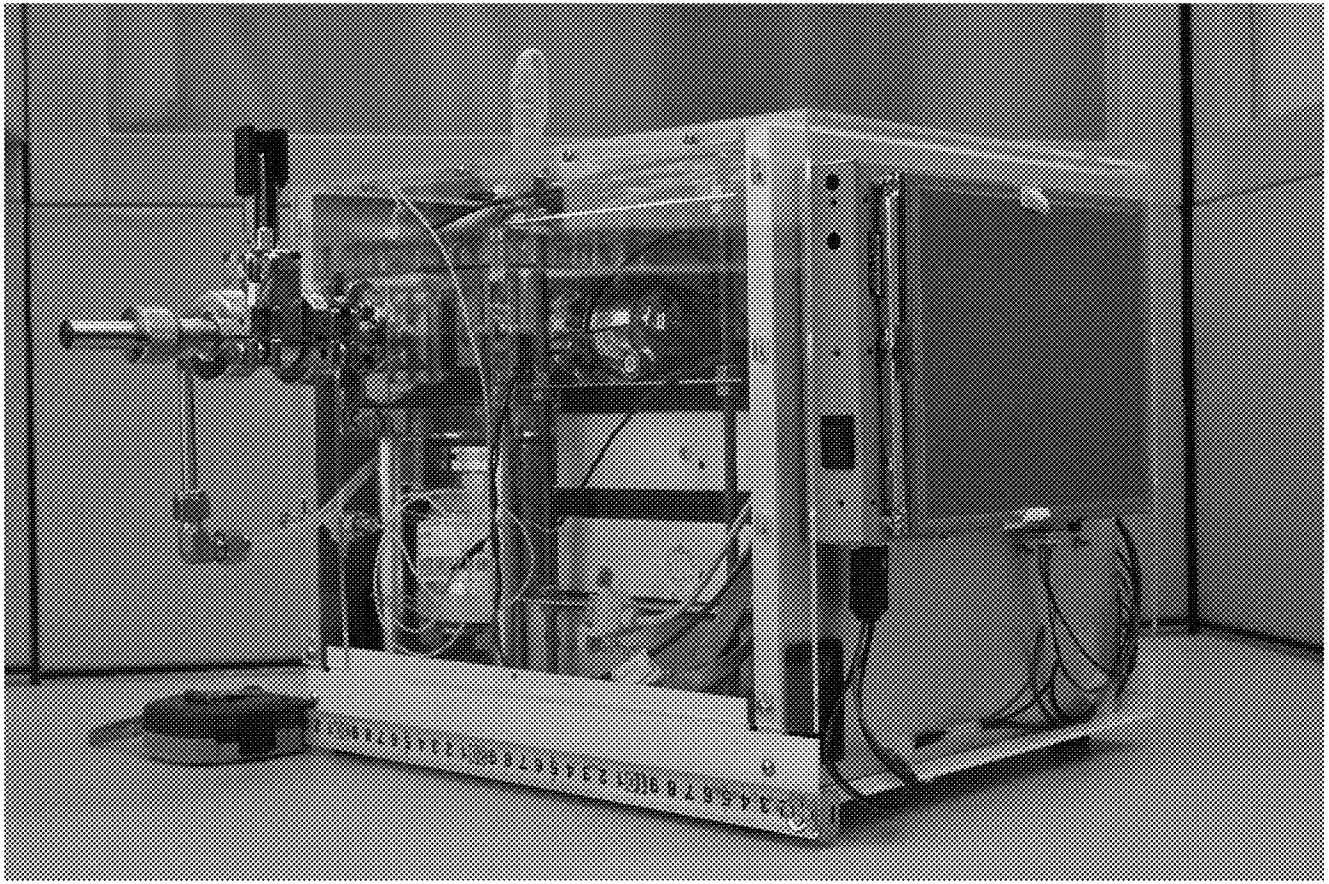
Figure 7C:
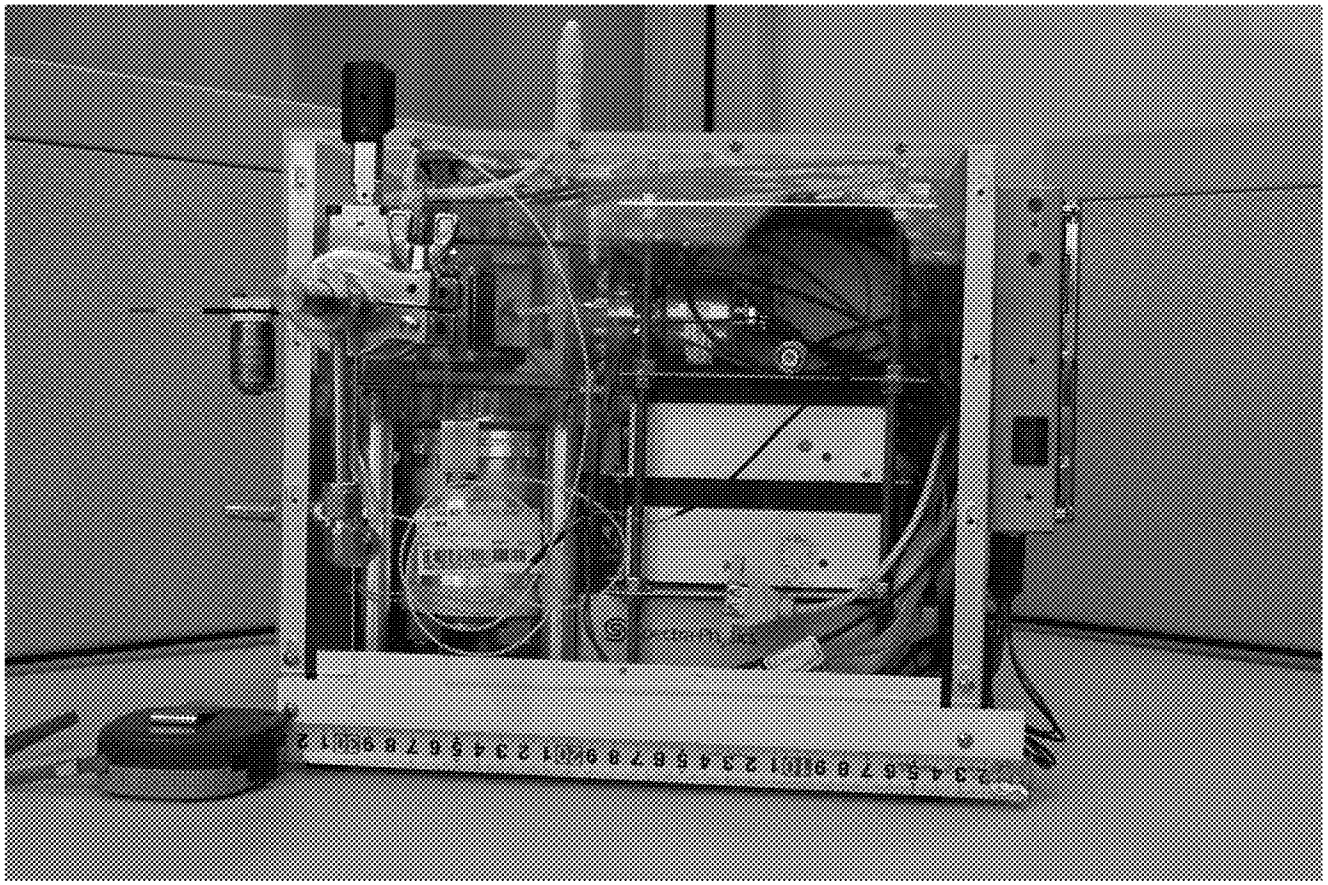
Figure 7D:
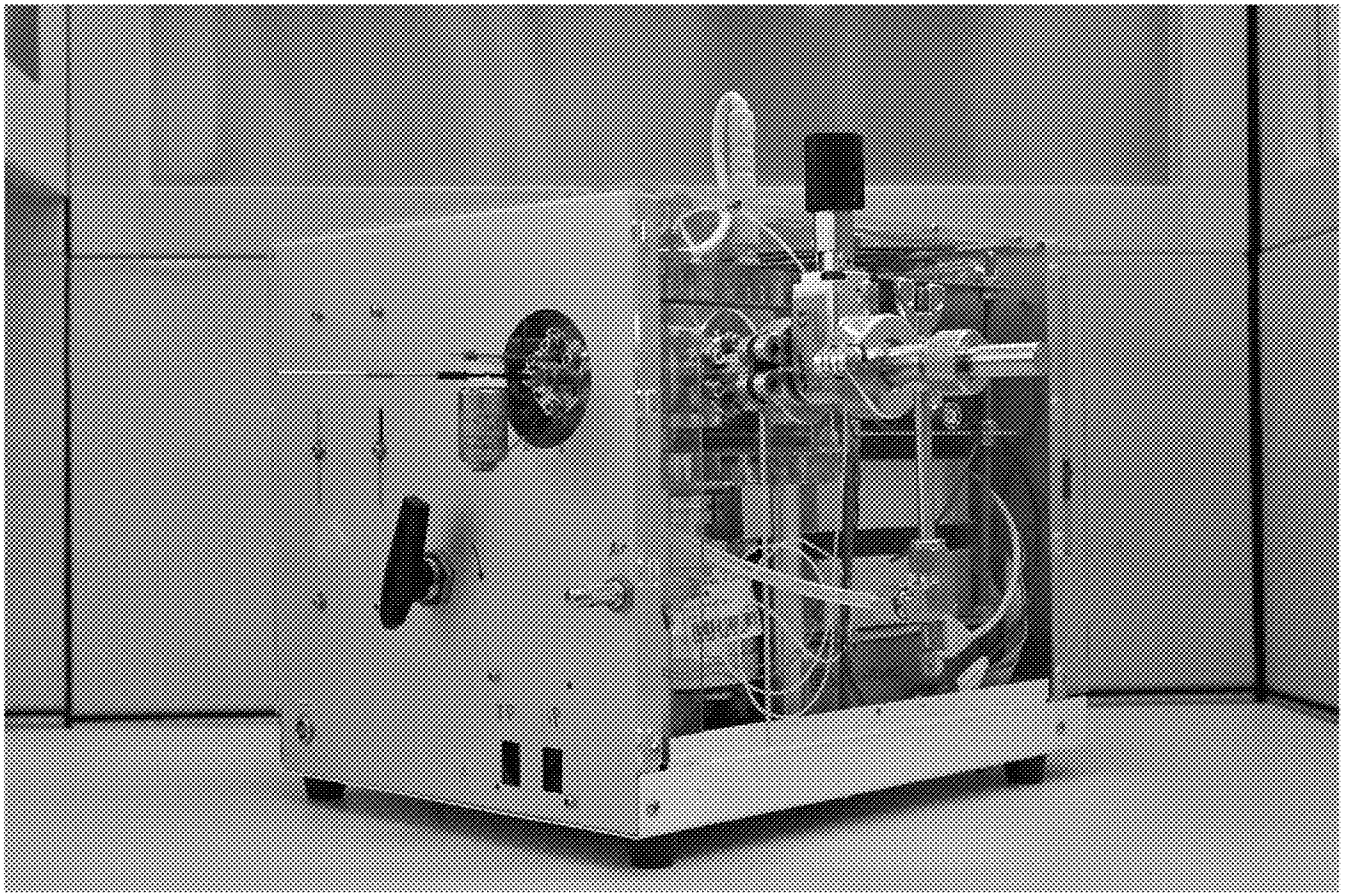
Figure 7E:
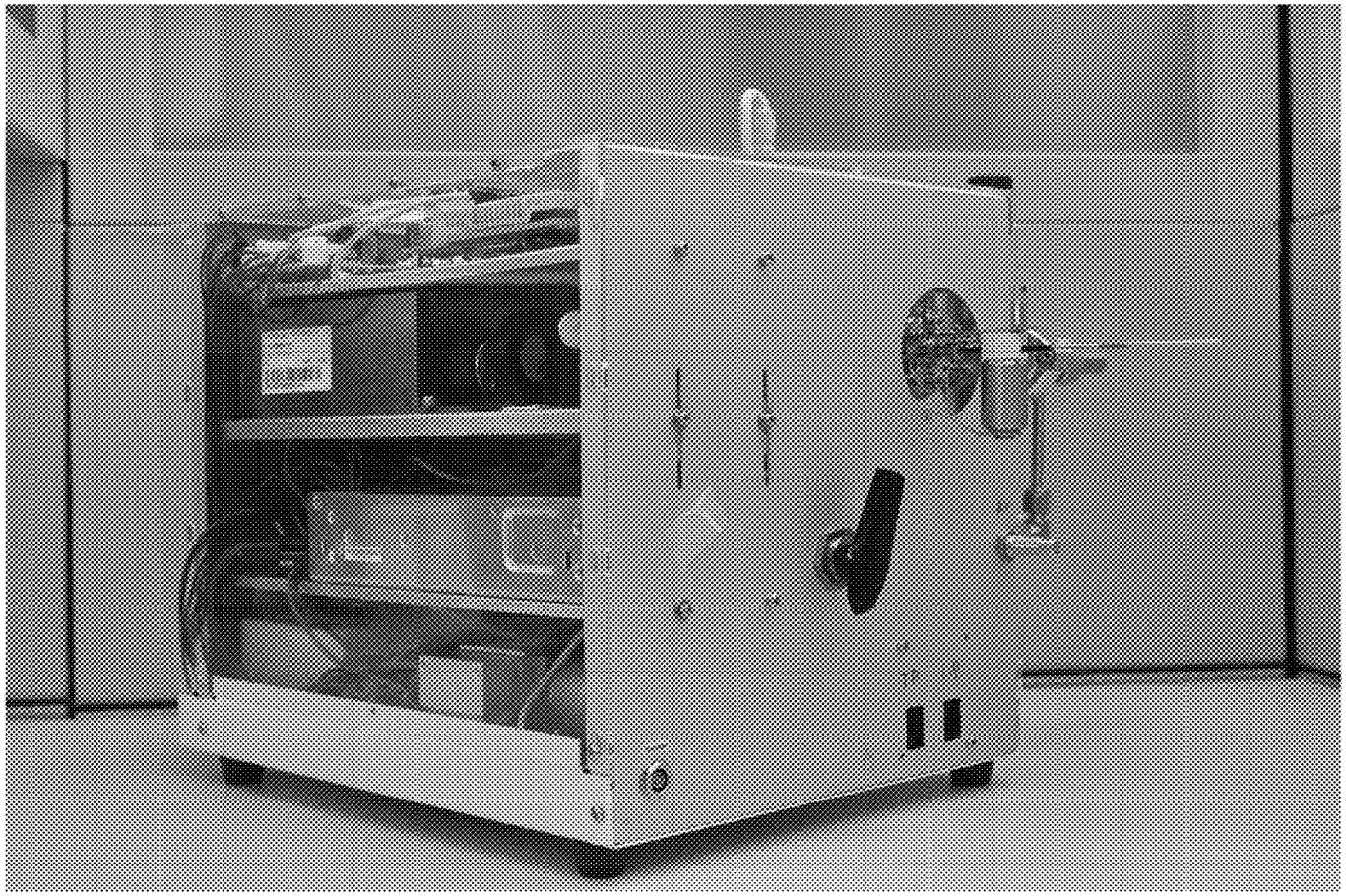
Figure 7F:
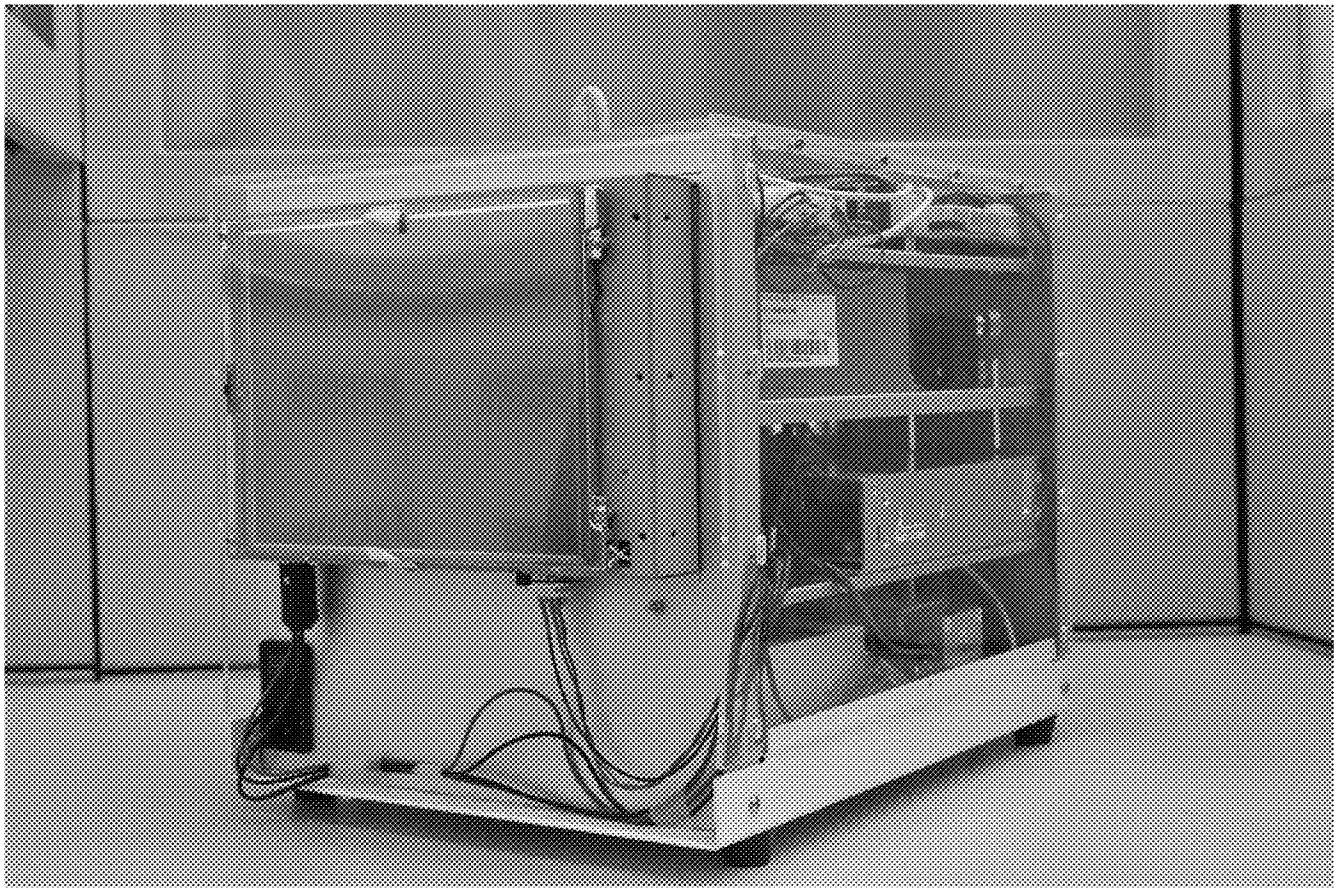

The portable mass spectrometer further included a high voltage operational amplifier. The high voltage operational amplifier was made by coupling, on a dedicated printed circuit board (with a size of about 14 cm×14 cm), a high-voltage power bandwidth MOS-FET operational amplifier (APEX microtechnology, model PA85A) with positive and negative DC voltage power supplies that can amplify signal up to ±450 V (Matsusada Precision Inc., models S30-0.6N and S30-0.6P) (see FIG. 6C).

Particle detection was performed (together with off-board detector components such as the charge detection plate/cup and conversion dynode) by a channeltron pulse amplifier and pulse holder circuit for charge amplification detection, and by a charge detector pulse amplifier and pulse holder circuit for direct charge detection. These were part of the analog front end shown in FIG. 6B.

Multichannel analog and digital input/output (I/O) were performed by a 10-channel ADC, an 8-channel DAC, general purpose digital I/O interface, and USB interface. The 10-channel ADC read particle detection pulse data from the analog front end (and, optionally, analog signal from off board devices). The 8-channel DAC provided analog control of off-board devices, including the conversion dynode, pinch valve, ionization source, etc. The USB interface was used for upstream control of the apparatus and/or for data output.

This apparatus was powered by an external power source such as a wall socket or generator. A portable apparatus with a self-contained power source is constructed, based on the instrument as described in this example, by including in the casing of the mass spectrometer a lithium-ion battery and connecting the battery to the powered components of the apparatus. The lithium-ion battery is similar to batteries that power laptop computers and is capable of supplying 150 W power. The analytical capabilities of this battery-powered mass spectrometer are expected to be similar to those of the wall socket- or generator-powered instrument described above.

Example 2

MALDI with the Portable Mass Spectrometer

Figure 4:
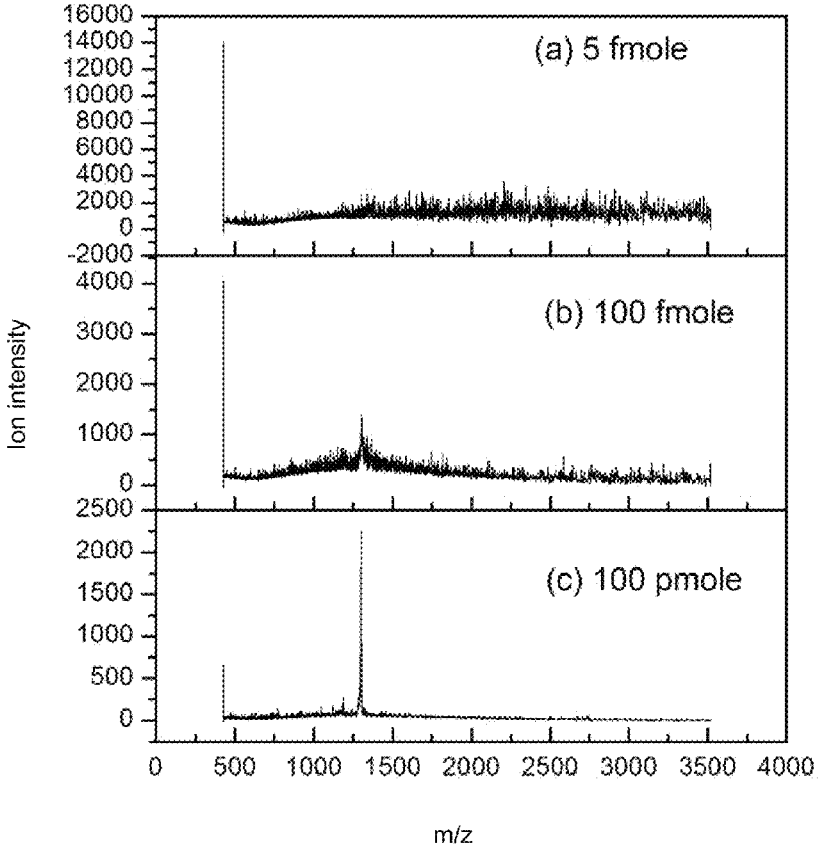
FIG. 4. MALDI mass spectra of angiotensin. Five femtomoles, 100 femtomoles, or 100 picomoles of angiotensin were placed on the MALDI plate of the portable mass spectrometer of Example 1 in a 2,5-dihydroxybenzoic acid matrix. The mass spectra were acquired as described in Example 2.

Five femtomoles, 100 femtomoles, or 100 picomoles of angiotensin were placed on the MALDI sample plate of the portable mass spectrometer, and a 2,5-dihydroxybenzoic acid matrix was used. Desorption-ionization was achieved using 20 laser pulses, and the analyte was introduced to the quadrupole ion trap mass analyzer, which had an internal pressure of 2 mTorr. MALDI mass spectra obtained by frequency scanning using each of these amounts of angiotensin are shown in FIG. 4 ((a) 5 fmole; (b) 100 fmole; (c) 100 pmole). In each mass spectrum, the principal peak was protonated angiotensin. The lowest quantity of angiotensin detectable using the portable mass spectrometer was 5 fmole (FIG. 4(*a*)).

Example 3

ESI with the Portable Mass Spectrometer

Figure 5A:
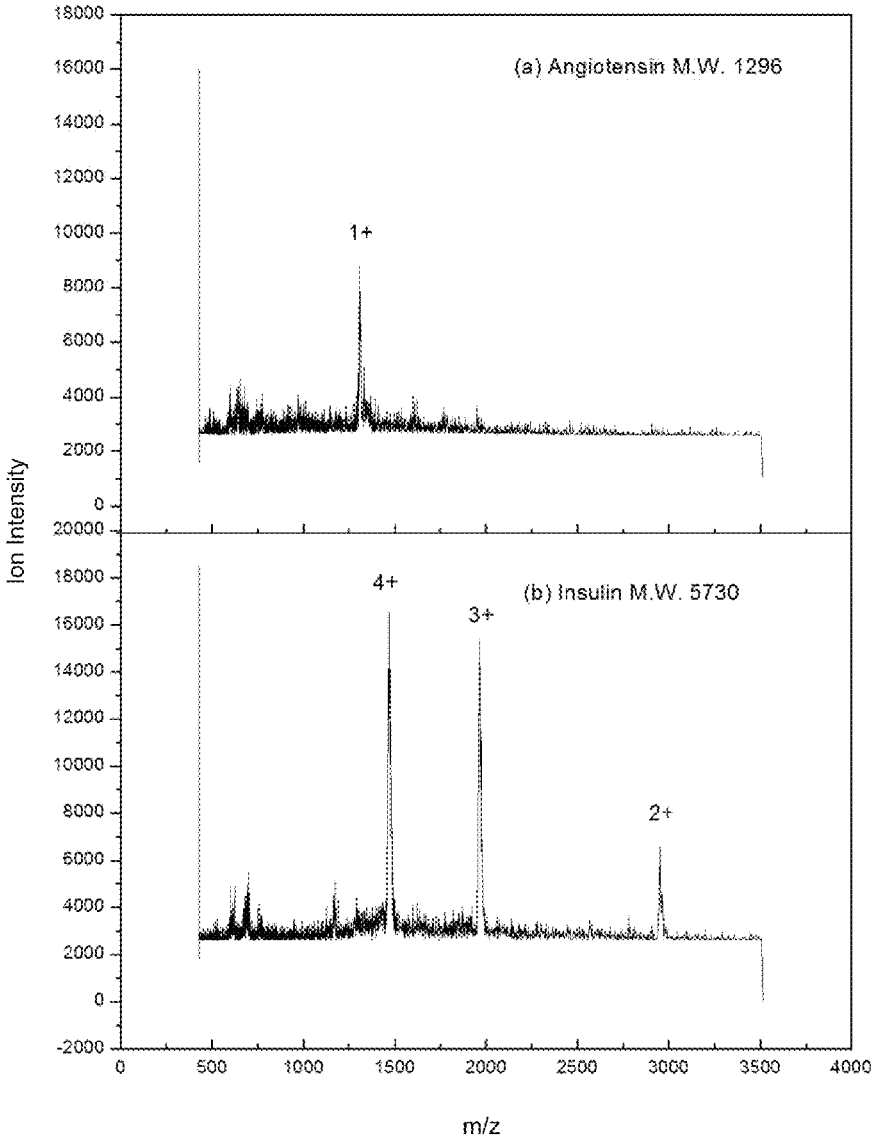
FIG. 5A. ESI mass spectra of angiotensin (a; top) and insulin (b; bottom). Angiotensin and insulin, each at a concentration of 10 μM in methanol/water/acetic acid, were analyzed by atmosphere ESI-MS using the apparatus of Example 1, as described in Example 3. The peaks in (b) labeled 3+ and 4+ correspond to triprotonated and tetraprotonated insulin, respectively.
Figure 5B:
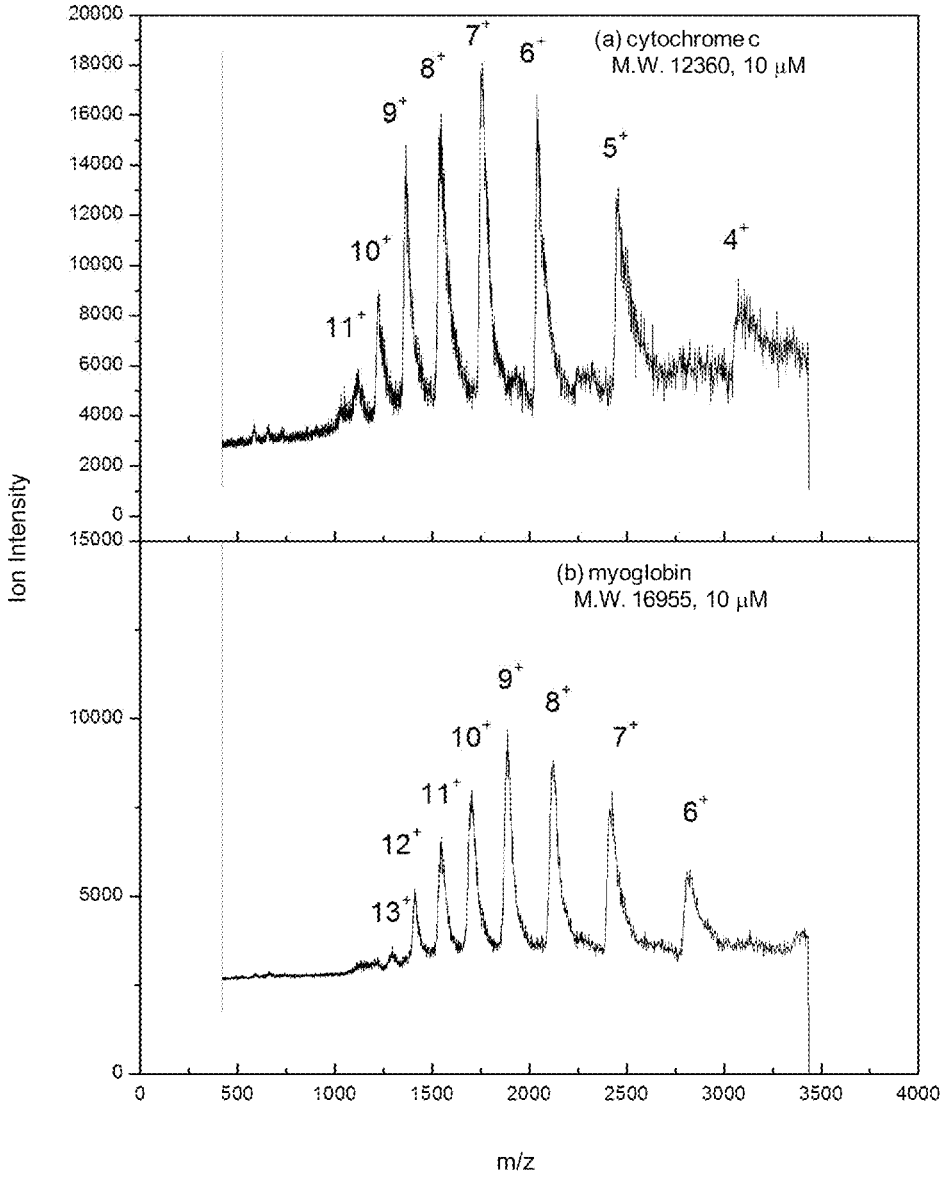
FIG. 5B. ESI mass spectra of cytochrome c (a; top) and myoglobin (b; bottom). Cytochrome c and myoglobin, each at a concentration of 10 μM in methanol/water/acetic acid, were analyzed by atmosphere ESI-MS using the apparatus of Example 1, as described in Example 2.

Pulsed-mode atmospheric ESI was performed separately with insulin, angiotensin, cytochrome c, and myoglobin, each at a concentration of $10^{-5}$ M in 45% methanol/45% water/10% acetic acid. To perform electrospray ionization, a 30 μm picotip emitter was used together with a KDS-100 syringe pump. Sample was introduced into this source using a 100-μl Hamilton syringe. The syringe flow rate was 60 μl/h, the emitter voltage was 2.5 kV, and the ion introduction time was 5 s. A 127-μm-i.d. stainless steel capillary inlet coupled with a 2-way normally closed pinch valve were controlled by a pulsed function generator; the pinch valve opened upon a 24 V DC signal. The pinch valve and capillary were connected using a 1/16" i.d. silicon tube. The internal pressure of the quadrupole ion trap mass analyzer was reduced to 0.8 mTorr after sample introduction. A frequency scan was performed from 300 to 100 kHz in a scan time of 1 s. The ESI mass spectra of angiotensin and insulin are shown in FIG. 5A (a) and (b), respectively. The mass spectra were observed by increasing the sample molecular weight selected by the ion trap to over 10 kD. ESI spectra of cytochrome c and myoglobin are shown in FIG. 5B (a) and (b), respectively. Peaks from multiple charged species are labeled in FIGS. 5A and 5B.

Example 4

Ion Enrichment and Collision-Induced Dissociation

Figure 8:
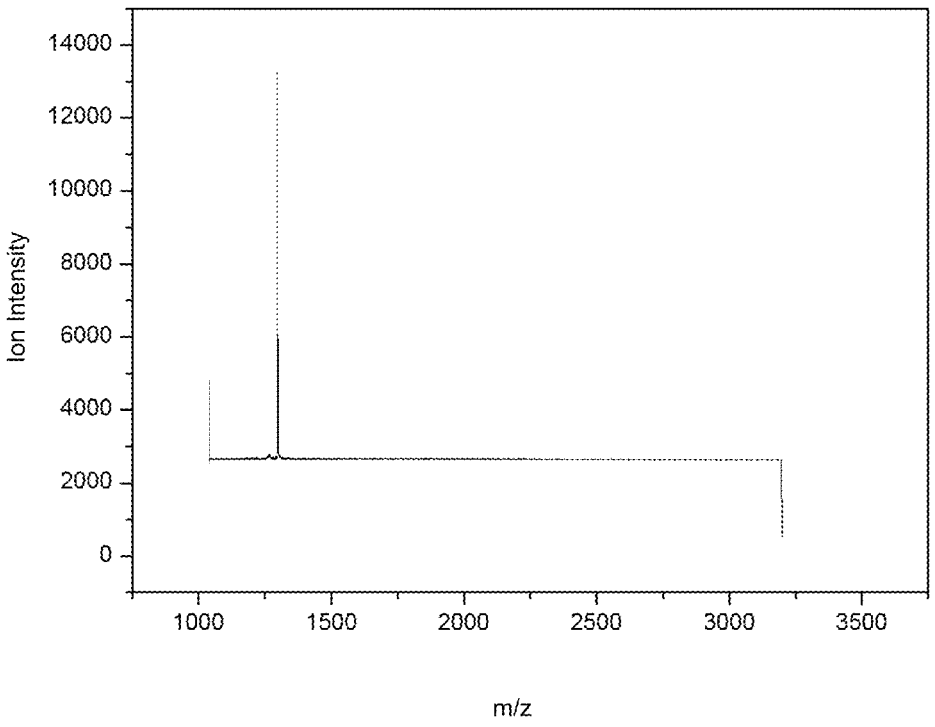
FIG. 8. Mass spectrum of angiotensin obtained using frequency scanning and operating in resonance ejection to select ions of a particular m/z ratio. The principal peak is protonated angiotensin.

Ions with molecular masses of from about 500 Da to about 2 MDa were produced from a sample and were introduced into a mass analyzer comprising an ion trap of the portable apparatus with a self-contained power source of Example 1. Ions of a particular m/z ratio were selected by voltage scanning. The mass spectrum of angiotensin obtained by using frequency scanning from 300 to 100 kHz, 800 Vpp (peak-to-peak voltage), operating in resonance ejection (see below) with a supplementary AC of 150 kHz, 10 Vpp, is shown in FIG. 8. The principal peak in this mass spectrum was protonated angiotensin.

The selected ions in the trap are subjected to subsequent fragmentation for ion identification. Ions in an ion trap have a resonant frequency, which is dependent on the m/z ratio. Application of the resonant frequency to an ion results in excitation and an increased radius of oscillation by the ion, eventually leading to ejection of the ion. This does not cause ejection of ions with a different resonant frequency. A waveform containing multiple ion resonance excitation frequencies is synthesized by using fast Fourier transform technology. This waveform is generated by a home-made arbitrary function generator. This waveform is provided to an RF amplifier after the trapping of ions. By repeating this process, ions of a desired m/z ratio are selectively enriched as undesired ions are ejected. The desired ions are then analyzed by collision induced dissociation, and thereby, information is obtained about their structure.

Example 5

Detection of Ejected Ions

Frequency scanning can be used for detection of macromolecules and larger particles, and voltage scanning can be used for high resolution spectra of analyte such as small organic compounds. Ionized sample molecules were ejected from the ion trap of a portable mass spectrometer with a self-contained power source, traveling through one of two exit ports. A charge detector was installed immediately outside of one exit port to measure charge directly. The data from the charge detector contained intrinsic electronic background which, depending on the electronic circuit and mass spectrometer design, was equivalent to about 200 electrons. A conversion dynode biased with a high voltage was installed outside of the other exit port. The secondary ions or electrons that were ejected from the conversion dynode subsequently were detected by a charge amplification device. For detecting small ions (m/z<10,000) exiting from the trap, the conversion dynode was biased for secondary electron emission. For detecting large molecular ions (m/z>10,000), the conversion dynode and charge amplification detector were set up for emission and detection of secondary ions, respectively.

Figure 9A:
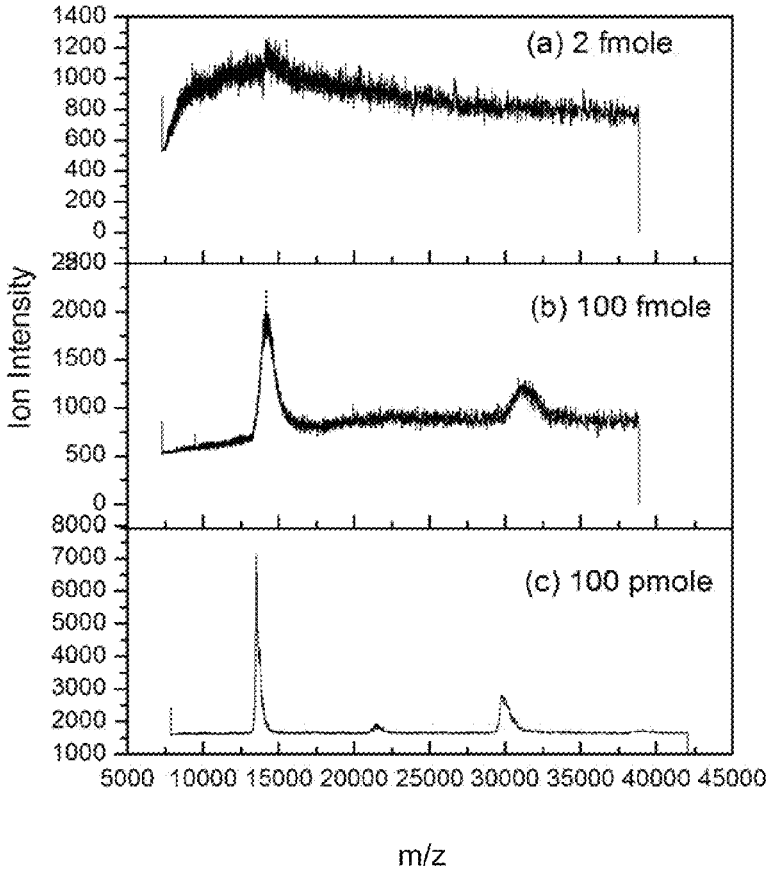
FIG. 9A. MALDI mass spectra of cytochrome c. Spectra of 2 fmole (a), 100 fmole (b), and 100 pmole (c) cytochrome c were obtained with a 10 kV voltage applied to the conversion dynode of the portable mass spectrometer.

Comparative MALDI mass spectra of different amounts of cytochrome c are shown in FIG. 9A ((a) 2 fmole, (b) 100 fmole, and (c) 100 pmole). In order to enhance secondary ion emission efficiency with large molecular weight molecules, a high voltage of 10 kV was applied to the conversion dynode. The lowest quantity of cytochrome c detectable using the portable mass spectrometer was 2 fmole (FIG. 9A(a)).

Figure 9B:
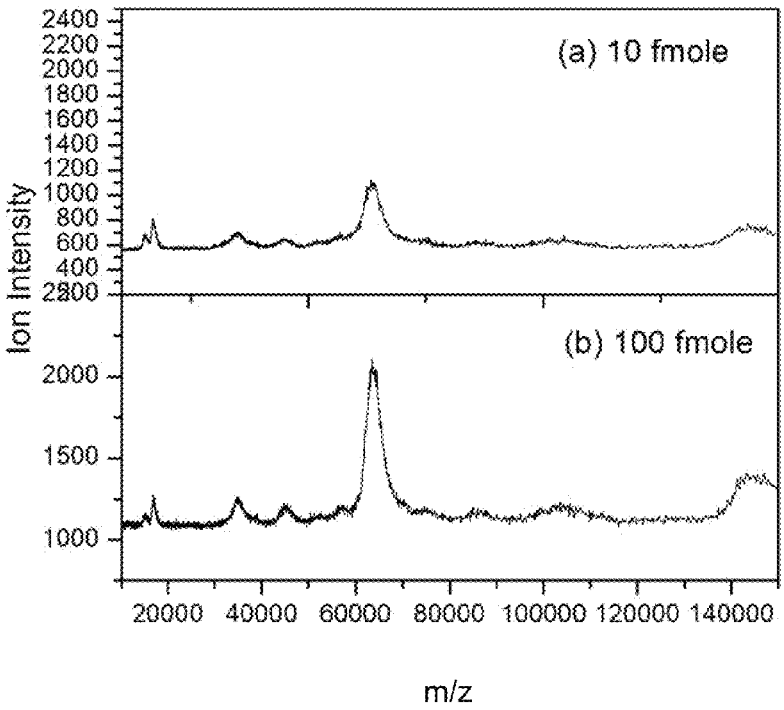
FIG. 9B. MALDI mass spectra of bovine serum albumin (BSA). Spectra of 10 fmole (a) and 100 fmole (b) BSA were obtained with a 20 kV voltage applied to the conversion dynode of the portable mass spectrometer.

MALDI spectra of different amounts of BSA obtained in a similar manner are shown in FIG. 9B ((a) 10 fmole, and (b) 100 fmole). A high voltage of 20 kV was applied to the conversion dynode, enhancing secondary ion emission efficiency. The lowest quantity of BSA detectable using the mass spectrometer was 10 fmole (FIG. 9B(a)).

Figure 9C:
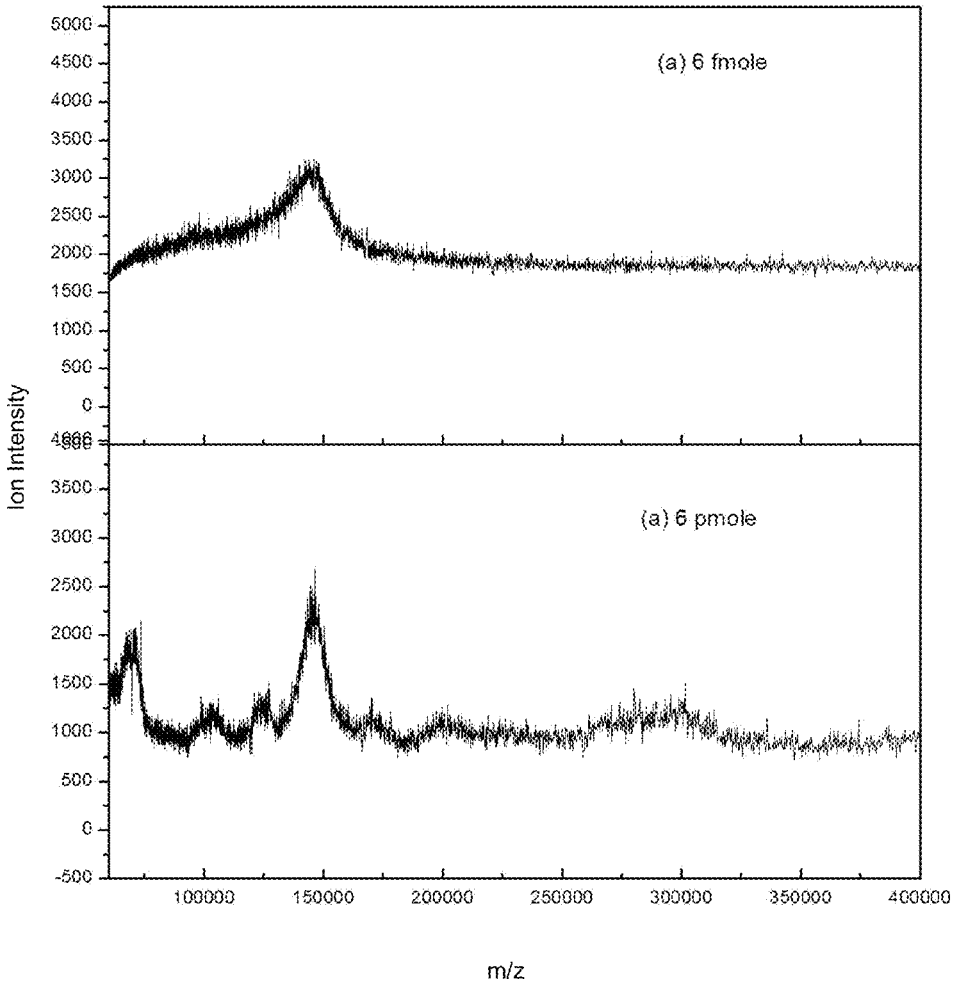
FIG. 9C. MALDI mass spectra of Immunoglobulin G (IgG). Spectra of 6 fmole (a) and 6 pmole (c) IgG were obtained with a 20 kV voltage applied to the conversion dynode of the portable mass spectrometer.

When the molecular weight of the sample was over 150 kD, mass spectra could still be observed. MALDI mass spectra of different amounts of IgG are shown in FIG. 9C ((a) 6 fmole, and (b) 6 pmole). The lowest quantity of IgG detectable using the mass spectrometer was 6 fmole FIG. 9C(a).

Example 6

Mass Analysis by Voltage Scanning

Figure 10:
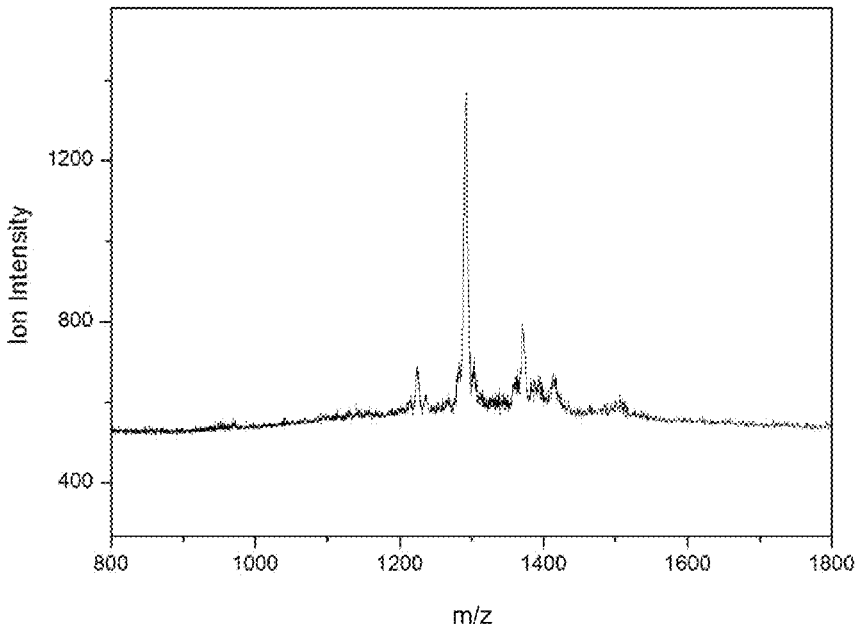
FIG. 10. Quadrupole ion trap laser desorption mass spectrum of angiotensis. The spectrum of angiotensin was obtained using by voltage scanning and selecting ions with selected m/z ratios with fixed trapping frequencies.

A high voltage sine wave for voltage scanning was generated by using a resonating electronic LC circuit in a portable mass spectrometer with a self-contained power source. The resonance frequency was equal to $(L/C)^{1/2}$, where L is inductance and C is capacitance. A home-made air type cylindrical coil inductor was fabricated with an inductance determined as $\mu_0 K N^2 A l^{-1}$, where $\mu_0$ is the permeability of free space, K is the Nagaoka coefficient, N is the number of turns, A is the cross-sectional area, and l is the length of the coil. For voltage scanning, the ion trap field oscillation frequency was fixed and the capacitance of the ion trap was determined, allowing calculation of the inductance to give resonance at the fixed frequency. The cylindrical coil was fabricated with parameters according to the inductance formula so that it supports use for amplification. The home-made sine wave amplifier generated primary side voltage, which was passed through the inductor to generate secondary side high voltage. Primary side voltage was ramped to a high level using the resonance of the circuit. The air inductor had a diameter of 36 mm and a loading capacity of 50 pF; the primary side wire had a diameter of 0.2 mm and had 1 turn; and the secondary side wire had a diameter of 1 mm and had 100 turns. The voltage could be ramped to 3 kVpp at 700 kHz. The pulse generator, coupled with the power supply, was used for trapping ions with a selected m/z to enrich the selected ions. A quadrupole ion trap laser desorption mass spectrum of angiotensin (FIG. 10) was obtained using ramped trapping voltage and fixed trapping frequency.

Example 7

Data Processing and Analysis

Signals obtained from the direct charge detector and/or the charge amplification detector of a portable mass spectrometer with a self-contained power source were fed into a built-in computer for analysis. The mass spectrum was shown on the computer display. Digital data were saved in the computer or on a removable USB drive for further analysis.

Figure 11:
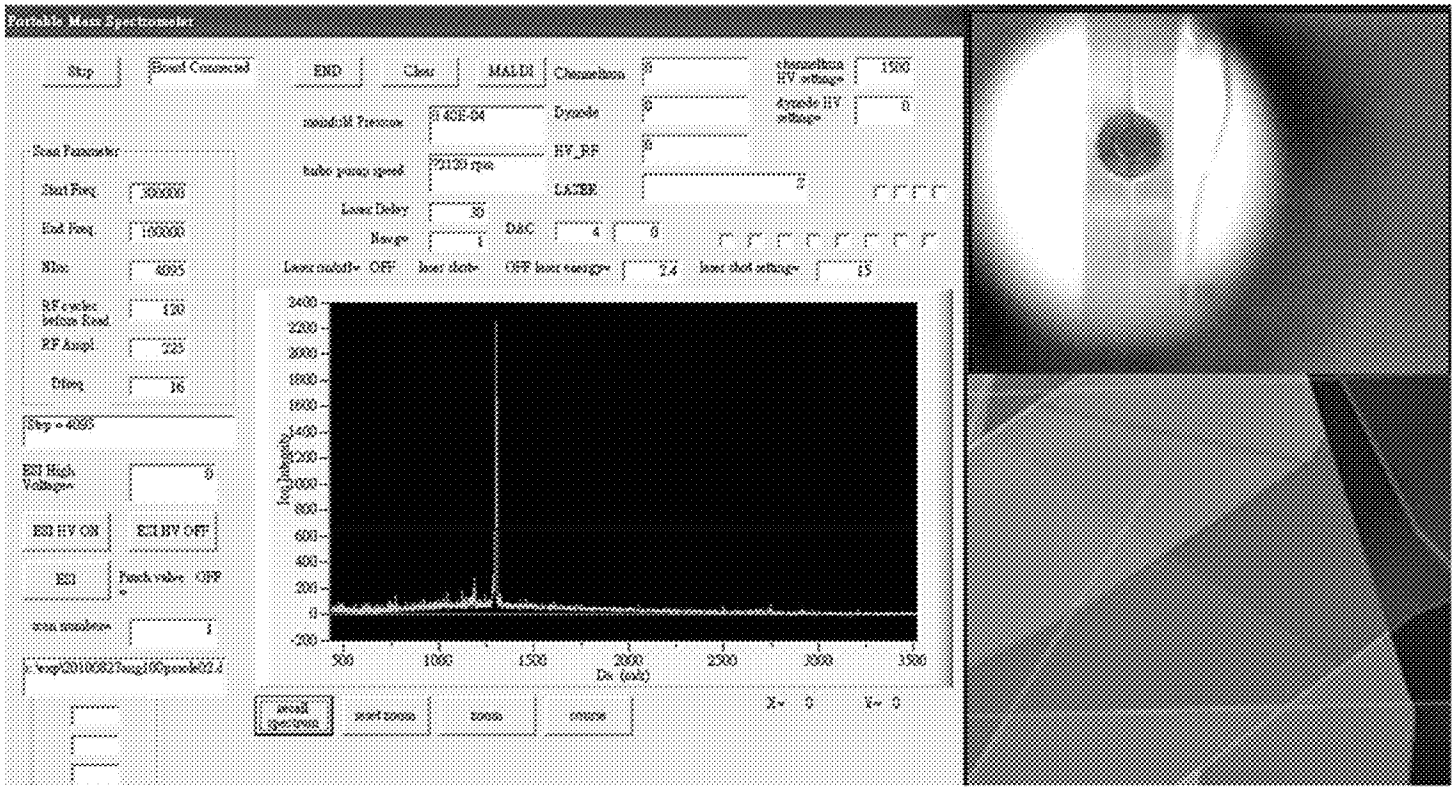
FIG. 11. Snapshot of software user interface of the portable mass spectrometer.

Data were acquired by charge amplification. Analog signal from the detector was converted to digital signal by a home-made A/D converter. The A/D converter was programmed using Visual basic or C++ to control data input and output. The software analyzed the digital signal and information from the sine wave function generator to plot a mass spectrum, which was shown, optionally with parameters describing data acquisition and/or processing, on a 7" LCD display. A snapshot of the software user interface of the portable mass spectrometer is shown in FIG. 11.

The embodiments within the specification provide an illustration of embodiments of the invention and should not be construed to limit the scope of the invention. The skilled artisan readily recognizes that many other embodiments are encompassed by the invention. All publications and patents cited in this disclosure are incorporated by reference in their entirety. To the extent the material incorporated by reference contradicts or is inconsistent with this specification, the specification will supersede any such material. The citation of any references herein is not an admission that such references are prior art to the present invention.

Unless otherwise indicated, all numbers expressing quantities of ingredients, reaction conditions, and so forth used in the specification, including the claims, are to be understood as being modified in all instances by the term "about." Accordingly, unless otherwise indicated to the contrary, the numerical parameters are approximations and may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

Unless otherwise indicated, the term "at least" preceding a series of elements is to be understood to refer to every element in the series. Those skilled in the art will recognize, or be able to ascertain using no more than routine experimentation, many equivalents to the specific embodiments of the invention described herein. Such equivalents are intended to be encompassed by the following claims.

A claimed embodiment that is recited as comprising certain components or steps and not comprising certain other component(s) or step(s) is understood to be open except for the excluded component(s) or step(s); that is, an apparatus or method comprising the excluded component(s) or step(s) would be outside the scope of the claimed embodiment in question.

A claimed embodiment that "is configured to" perform a recited function or "is capable of" performing a recited function is understood to have its components arranged in a manner that the apparatus can do what is recited when external necessities (e.g., a sample for analysis; external necessities can further include an external computer, an external source of energy, etc., depending on the specifics of the apparatus) are provided. Generally, an apparatus is considered to be "configured to" perform a function or "capable of" performing a function if only routine setup (including steps such as introduction of a sample and computer-controlled initialization, which may optionally occur on the command of a user) is needed in order to actually perform the function, but not if internal components of the apparatus must be added, exchanged, or manually reconfigured (e.g., by changing the way the components are connected to each other).

What is claimed is:

1. An apparatus for mass spectrometry comprising:

a. at least two mechanistically different sources of ionized analyte;

b. a mass analyzer comprising at least one ion trap having a ring electrode and two end-cap electrodes;

c. at least one frequency scanning subsystem configured to generate a constant amplitude RF trapping frequency scan in a series of RF frequency steps, wherein during each step the RF frequency is maintained at a value for a whole integer number of cycles and then stepped to a different RF frequency; and d. at least one charge detector and at least one charge amplification detector;

wherein the at least one ion trap is configured to operate via the RF frequency scan by applying the stepped constant amplitude RF trapping frequency scan to the ring electrode; and wherein the apparatus has an extended mass detection range from 10 to $10^{16}$ Da.

2. The apparatus of claim 1, wherein the apparatus comprises at least one vacuum pump.

3. The apparatus of claim 1, wherein the apparatus does not comprise a vacuum pump.

4. The apparatus of claim 1, wherein the at least two mechanistically different sources of ionized analyte comprise:

a. a first source of ionized analyte chosen from a MALDI source and a LIAD source; and b. at least one additional source of ionized analyte mechanistically different from the first source of ionized analyte.

5. The apparatus of claim 1, wherein the at least one ion trap is a quadrupole ion trap.

6. The apparatus of claim 1, wherein the at least two different sources of ionized analyte are chosen from a LIAD source, a MALDI source, an ESI source, an EI source, a GDEI source, an APCI source, a DESI source, a DART source, an LTP source, a UI source, an EII source, and an EA source.

7. The apparatus of claim 1, wherein the apparatus is configured to obtain a mass spectrum of an analyte having an m/z ratio of from 10 to $10^{18}$.

8. The apparatus of claim 1, wherein the apparatus has a mass of less than 40 kg.

9. The apparatus of claim 1, wherein the at least one charge detector comprises a detector chosen from a Faraday plate, a Faraday cup, an induction charge detector, a microchannel plate, a microsphere plate, a electromultiplier, a channeltron, and a CCD camera.

10. The apparatus of claim 1, wherein the apparatus is configured to measure analyte charge and analyte m/z ratio.

11. The apparatus of claim 1, further comprising a pulsed valve between the source of ionized analyte and the mass analyzer for creating a pulsed beam of the ionized analyte.

12. A method for obtaining a mass spectrum, the method comprising the steps of:

a. providing a sample comprising an analyte;

b. ionizing the analyte;

c. introducing the ionized analyte into a mass analyzer comprising at least one ion trap having a ring electrode and two end-cap electrodes;

d. operating at least one frequency scanning subsystem configured to generate a constant amplitude RF trapping frequency scan in a series of RF frequency steps, wherein during each step the RF frequency is maintained at a value for a whole integer number of cycles and then stepped to a different frequency, and wherein the stepped constant amplitude RF trapping frequency scan is applied to the ring electrode;

e. sorting the analyte according to its m/z ratio by operating the ion trap with an RF frequency scan supplied by the frequency scanning subsystem; and f. detecting the analyte sorted according to its m/z ratio with at least one charge detector and at least one charge amplification detector, thereby obtaining a mass spectrum; wherein the analyte has a mass from 10 to $10^{16}$ Da.

13. The method of claim 12, further comprising selecting a mass range or an m/z range within the mass spectrum of step (f), and obtaining a second mass spectrum, wherein the second mass spectrum employs a voltage scan or a frequency scan for sorting the analyte according to its m/z ratio.

14. The method of claim 12, wherein step (b) comprises ionizing the analyte or changing the ionization state of the analyte.

15. The method of claim 12, further comprising performing collision-induced dissociation on the analyte prior to step (e).

16. The method of claim 12, wherein detecting the analyte comprises generating and detecting secondary ions or electrons.

* * * * *